US006447969B1

(12) United States Patent
Ito et al.

(10) Patent No.: US 6,447,969 B1
(45) Date of Patent: Sep. 10, 2002

(54) TONER AND IMAGE FORMING METHOD

(75) Inventors: Masanori Ito, Numazu; Tsutomu Kukimoto, Yokohama; Tsuyoshi Takiguchi, Shizuoka-ken; Tatsuhiko Chiba, Kamakura; Michihisa Magome, Shizuoka-ken; Akira Hashimoto, Mishima; Keiji Komoto, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/580,409

(22) Filed: May 30, 2000

(30) Foreign Application Priority Data

Jun. 2, 1999 (JP) ..... 11-154473
Feb. 21, 2000 (JP) ..... 2000-043662

(51) Int. Cl.[7] ..... G03G 9/083; G03G 13/09

(52) U.S. Cl. ..... 430/106.2; 430/101; 430/110.1; 430/110.3; 430/110.4; 430/111.4; 430/122; 430/126

(58) Field of Search ..... 430/106.6, 111, 430/110, 110.2, 110.3, 110.4, 110.1, 106.2, 108.8, 111.4, 137.17, 106.1, 101, 122, 126

(56) References Cited

U.S. PATENT DOCUMENTS

| | | | | |
|---|---|---|---|---|
| 3,909,258 | A | | 9/1975 | Kotz |
| 4,108,786 | A | | 8/1978 | Takayama et al. ..... 252/62.1 |
| 4,380,384 | A | | 4/1983 | Ueno et al. |
| 4,530,894 | A | | 7/1985 | Imamura et al. ..... 430/106.6 |
| 4,620,987 | A | | 11/1986 | Yamashita et al. ..... 427/131 |
| 4,664,504 | A | | 5/1987 | Oda et al. |
| 4,727,395 | A | | 2/1988 | Oda et al. |
| 4,769,676 | A | | 9/1988 | Mukai et al. |
| 4,820,603 | A | | 4/1989 | Sakashita ..... 430/106.6 |
| 4,843,424 | A | | 6/1989 | Oda et al. |
| 4,851,960 | A | | 7/1989 | Nakamura et al. ..... 361/225 |
| 4,904,562 | A | * | 2/1990 | Yusa et al. ..... 430/106.6 |
| 4,957,840 | A | | 9/1990 | Sakashita et al. ..... 430/106.6 |
| 4,992,191 | A | | 2/1991 | Mori et al. ..... 252/62.59 |
| 5,014,089 | A | | 5/1991 | Sakashita et al. |
| 5,137,796 | A | | 8/1992 | Takiguchi et al. ..... 430/106.6 |
| 5,194,359 | A | | 3/1993 | Kanbe et al. ..... 430/120 |
| 5,262,267 | A | | 11/1993 | Takiguchi et al. ..... 430/122 |
| 5,282,007 | A | | 1/1994 | Oshiumi |
| 5,310,615 | A | | 5/1994 | Tanikawa ..... 430/106.6 |
| 5,450,180 | A | | 9/1995 | Ohzeki et al. |
| 5,672,454 | A | | 9/1997 | Sasaki et al. ..... 430/106.6 |
| 5,721,433 | A | | 2/1998 | Kosaka ..... 250/573 |
| 6,132,919 | A | * | 10/2000 | Ogawa et al. ..... 430/110 |

FOREIGN PATENT DOCUMENTS

| | | | |
|---|---|---|---|
| EP | 0715230 | | 6/1996 |
| EP | 886187 | A2 * | 12/1998 |
| EP | 905569 | A2 * | 3/1999 |
| JP | 5443027 | | 4/1979 |
| JP | 5484731 | | 7/1979 |
| JP | 5518656 | | 2/1980 |
| JP | 5613945 | | 4/1981 |
| JP | 56104351 | | 8/1981 |
| JP | 57178257 | | 11/1982 |
| JP | 5840566 | | 3/1983 |
| JP | 58139156 | | 8/1983 |
| JP | 58150975 | | 9/1983 |
| JP | 59133573 | | 7/1984 |
| JP | 59200254 | | 11/1984 |
| JP | 59200256 | | 11/1984 |
| JP | 59200257 | | 11/1984 |
| JP | 59224102 | | 12/1984 |
| JP | 6134070 | | 2/1986 |
| JP | 61279864 | | 12/1986 |
| JP | 62203182 | | 9/1987 |
| JP | 62279352 | | 12/1987 |
| JP | 63133179 | | 6/1988 |
| JP | 63149669 | | 6/1988 |
| JP | 63235953 | | 9/1988 |
| JP | 63250660 | | 10/1988 |
| JP | 6420587 | | 1/1989 |
| JP | 1112253 | | 4/1989 |
| JP | 1191156 | | 8/1989 |
| JP | 2123385 | | 5/1990 |
| JP | 2214156 | | 8/1990 |
| JP | 2284158 | | 11/1990 |
| JP | 2302772 | | 12/1990 |
| JP | 39045 | | 2/1991 |
| JP | 3181952 | | 8/1991 |
| JP | 4162048 | | 6/1992 |
| JP | 553482 | | 3/1993 |
| JP | 561383 | | 3/1993 |
| JP | 772654 | | 3/1995 |
| JP | 7209904 | | 8/1995 |
| JP | 8136439 | | 5/1996 |

OTHER PUBLICATIONS

Derwent Abstract An 1988–335803/198847 of JP 63250660, 1988.*

Database WPI, Sectn., Ch, Wk. 199004, Derwent Publ., AN 1990–25890, XP002147000 for JP 01–303446.

Database WPI, Sectn. Ch, Wk. 199339, Derwent AN 1993–306079, XP002147001, for JP 05–216270.

* cited by examiner

*Primary Examiner*—Janis L. Dote
(74) *Attorney, Agent, or Firm*—Fitzpatrick, Cella, Harper & Scinto

(57) ABSTRACT

A toner is formed of toner particles each comprising a binder resin and iron oxide particles dispersed therein. The toner particles are characterized by uniform but non-surface-exposed dispersion of the iron oxide particles within the toner particles as represented by (i) a carbon content (A) and an iron content (B) giving a ratio B/A<0.001 at surfaces of the toner particles as measured by X-ray photoelectron spectroscopy, (ii) an average circularity of at least 0.970, and (iii) at least 50% by number of toner particles satisfying D/C≦0.02, wherein C denotes a projection area-equivalent circular diameter of each toner particle and D denotes a minimum distance of iron oxide particles from a surface of the toner particle, based on a sectional view of the toner particle as observed through a transmission electron microscope (TEM).

35 Claims, 5 Drawing Sheets

TONER AND IMAGE FORMING METHOD

FIELD OF THE INVENTION AND RELATED ART

The present invention relates to a toner and an image forming method used in a recording method utilizing electrophotography, electrostatic recording, magnetic recording, toner jet recording, etc. More particularly, the present invention relates to a toner used in an image forming method for an image forming apparatus, such as a copying apparatus, wherein a toner image is once formed on an electrostatic image-bearing member and then transferred onto a transfer-receiving material to form an image thereon, and an image forming method using the toner.

Hitherto, a large number of electrophotographic processes have been known. Generally, in these processes, an electrostatic latent image is formed on an electrostatic image-bearing member (hereinafter represented by a "photosensitive member") utilizing ordinarily a photoconductive material, the latent image is then developed with a toner to form a visible toner image, and the toner image, after being transferred as desired onto a transfer-receiving material such as paper, is fixed onto the transfer-receiving material by application of pressure, heat, etc., to provide a product copy or print. As a method for visualizing the electrostatic latent image, there have been known the cascade developing method, the magnetic brush developing method, the jumping developing method, the pressure developing method, etc.

U.S. Pat. No. 3,909,258 has proposed a developing method using a magnetic toner having an electroconductivity. More specifically, in the developing method, an electroconductive magnetic toner carried on a hollow cylindrical electroconductive sleeve with a magnet installed inside thereof is caused to contact an electrostatic image to develop the image. In this instance, at the developing region, an electroconductive path is formed of the toner particles between the electrostatic image-bearing member and the sleeve surface, and the toner particles are supplied with a charge via the electroconductive path, whereby the toner particles are attached to the electrostatic image based on a Coulomb force acting between the charge and the electrostatic image. The developing method using an electroconductive magnetic toner is an excellent method obviating problems accompanying the conventional two-component developing method, but as the toner is electroconductive, the method is accompanied with a difficulty in electrostatically transferring the developed toner image from the electrostatic image-bearing member to a transfer-receiving material (or recording material) such as plain paper.

As a developing method using a high-resistivity magnetic toner allowing electrostatic transfer, one utilizing dielectric polarization of toner particles is known. Such a developing method however essentially involves problems, such as slow developing speed and insufficient developed image density, so that the commercialization is difficult.

As another developing method using a high-resistivity insulating magnetic toner, there is known a method wherein toner particles are triboelectrically charged through friction between individual toner particles and between toner particles and a friction member such as a sleeve, and the thus-charged toner particles are caused to contact an electrostatic image-bearing member to effect a development. This method is however accompanied with a problem that the triboelectric charge is liable to be insufficient due to few opportunities of contact between the toner particles and the friction member and much magnetic material exposed to the surfaces of the magnetic toner particles, leading to inferior images due to the insufficient charge.

As another developing method, Japanese Laid-Open Patent Application (JP-A) 54-43027 and JP-A 55-18656, for example, disclose a so-called jumping developing method wherein a magnetic developer (toner) is applied in a thin layer on a developer-carrying member to be triboelectrically charged thereon, and the charged layer of the magnetic toner is moved under the action of a magnetic field to be opposed in close proximity to but free of contact with an electrostatic latent image to effect a development. According to this method,the magnetic developer is allowed to be sufficiently triboelectrically charged by application in a thin layer on the developer-carrying member, and the developer carried under a magnetic force is used for development in a state free from contact with the electrostatic latent image, so that a high definition image can be obtained with suppression of so-called "fog" caused by transfer of the developer onto non-image parts.

Such a mono-component developing method, does not require carrier particles, such as glass beads or iron powder, so that a developing device therefor can be small-sized and light in weight. Further, while the two-component developing scheme requires devices for detecting a toner concentration in the developer and for replenishing a necessary amount of toner based on the detected result in order to keep a constant toner concentration in the developer, the mono-component developing scheme does not require such devices, thus allowing a small-sized and light developing device also from these points.

However, the developing method using an insulating magnetic toner involves an unstable factor a ttributable to the use of the insulating magnetic toner. This arises from the feature that a substantial amount of fine powdery magnetic material is contained in dispersion within the insulating magnetic toner particles and a portion of the magnetic material is exposed to the toner particle surfaces to affect the flowability and the triboelectric chargeability of the magnetic toner, thereby causing a change or deterioration of properties required of the magnetic toner, such as developing performance and continuous image forming performance.

The above-mentioned problems accompanying the use of a conventional magnetic toner containing a magnetic material is considered to be principally caused by the exposure of a magnetic material to the magnetic toner particle surface. More specifically, as a result of exposure of fine particles of magnetic material having a lower resistivity than a toner biner principally constituting the toner to the toner article surfaces, various difficulties are caused, such as a lowering in toner chargeability, a lowering in toner flowability, and developer deteriorations during a long term of use, such as peeling-off of the magnetic particles due to friction between individual toner particles and toner particles and the regulating member resulting in image density lowering and occurrence of density irregularity called "sleeve ghost".

Hitherto, various proposals have been made regarding magnetic iron oxide contained in magnetic toners, but room for improvement has yet been left.

For example, JP-A 62-279352 has proposed a magnetic toner containing silicon-containing magnetic iron oxide. The magnetic iron oxide is intentionally caused to contain silicon inside thereof, but the magnetic toner containing the magnetic iron oxide has left room for improvement regarding the flowability.

Japanese Patent Publication (JP-B) 3-9045 has proposed to provide magnetic iron oxide particles with a controlled spherical shape by adding a silicate salt thereto. The magnetic iron oxide particles obtained according to this proposal are caused to contain much silicon at an inner portion thereof and little silicon at the surface due to the use of a silicate salt for particle shape control and have a high surface smoothness. As a result, the resultant magnetic toner is provided with an improved flowability to some extent, but the adhesion between the toner binder resin and the magnetic iron oxide particles is liable to be insufficient.

JP-A 61-34070 has proposed a process for producing triiron tetroxide by adding a hydroxysilicate salt solution during oxidation to triiron tetroxide. The triiron tetroxide particles produced by the process contain Si in proximity to the surfaces thereof but are also caused to have a layer of Si in proximity to the surface thereof, so that the surface thereof is weak against a mechanical impact as by abrasion.

On the other hand, a toner has been conventionally produced through a (pulverization) process wherein a binder resin, a colorant (inclusive of a magnetic material in the case of a magnetic toner), etc., are melt-mixed for uniform dispersion, and then the mixture is pulverized by a pulverizer, and classified into toner particles having a prescribed particle size. This process however poses a restriction in material selection for complying with a recent trend for requiring a smaller particle size toner. For example, the resin-colorant dispersion mixture has to be sufficiently fragile so as to allow pulverization by a commercially feasible apparatus. If the resin-colorant dispersion mixture is sufficiently fragile for complying with the requirement, a practical high-speed pulverization of the resin-colorant dispersion mixture is liable to result in toner particles of a broad particle size range, particularly including a relatively large proportion of fine particle fraction (over-pulverized particles). Further, a toner composed of such a highly fragile material is subject to further pulverization or powder formation in copying apparatus, etc.

Further, according to the pulverization process, it is difficult to completely uniformly disperse solid fine particles of a magnetic material or a colorant in a resin, and the insufficient dispersion can lead to increased fog or lower image density while depending on the degree of the insufficiency. Further, the pulverization process essentially causes exposure of the magnetic iron oxide particles to the toner particle surfaces, thus inevitably leaving problems regarding toner flowability or charging stability in a severe environment.

Thus, the pulverization process poses a limit in production of finer toner particles as required in higher resolution and higher image quality, and the finer toner particle production is liable to result in remarkable deterioration in uniform chargeability and flowability of the toner.

For overcoming the above-mentioned problems of the pulverization process, the toner production by a suspension polymerization process has been proposed.

A toner produced through suspension polymerization (hereinafter sometimes called a "polymerization toner") can be easily provided with a small particle size and is excellent in flowability due to its spherical toner particle shape, thus being advantageous for complying with the requirement for higher image quality.

However, such a polymerization toner is liable to have remarkably lower flowability and chargeability when it contains a magnetic material. This is because generally hydrophillic magnetic particles are liable to be exposed to the toner particle surface. For solving the problem, it is important to modify the surface property of the magnetic material.

Regarding the surface modification of a magnetic material for improved dispersion thereof in a polymerization toner, many proposals have been made. For example, JP-A 59-200254, JP-A 59-200256, JP-A 59-200257 and JP-A 59-224102 have disclosed to treat magnetic materials with various silane coupling agents. JP-A 63-250660 has disclosed to treat silicon-containing magnetic particles with a silane coupling agent. JP-A 7-72654 has disclosed to treat magnetic iron oxide with alkyltrialkoxysilane.

By such treatment, the dispersibility of a magnetic material within a toner is improved to some extent, but uniform surface hydrophobization of a magnetic material is rather difficult. As a result, the occurrence of coalescence of magnetic particles and non-hydrophobized magnetic particles is inevitable, so that the surface modification (hydrophobization) is liable to be insufficient for achieving a good level of dispersibility in the toner.

A special toner containing magnetic particles only at a specific inner portion of particles thereof has been disclosed by JP-A 7-209904, in which, however, no reference is made to the sphericity of the toner particles.

To summarize the toner organization disclosed in JP-A 7-209904, each toner particle has a structure including a surface layer of at least a certain thickness in which no magnetic particles are present. This means that the toner particle includes a substantial surface layer portion containing no magnetic particles. In another expression, this however means that such a toner particle, when in a small average particle size of 10 $\mu$m, for example, includes only a small core volume in which magnetic particles are present, so that it is difficult to incorporate a sufficient amount of magnetic particles. Further, in case where such toner particles have a particle size distribution, a large toner particle and a small toner particle have different ratios of magnetic particle-free surface layers and thus different propositions of magnetic particles, so that the developing performance and transferability of the toner particles are different depending on the toner particle sizes, thus being liable to cause a selective development phenomenon depending on particle sizes (i.e., preferential consumption of a certain toner particle size fraction). As a result, if the toner having a certain particle size distribution is used for a long period of continual image formation, toner particles containing a larger proportion of magnetic particles and exhibiting a lower developing ability, i.e., larger toner particles, are liable to remain without being consumed for the development, thus causing lowering in image density and image quality and inferior fixability.

As for printer apparatus, laser beam printers and LED printers are becoming predominant on the market in recent years, and correspondingly, higher resolutions are being desired, e.g., from a conventional level of 240 and 300 dpi to 400, 600 and 800 dpi. For these reasons, the developing scheme is also required to be adapted for higher resolution. Further, also copying machines are required to comply with high functionality copying, and digital-mode copying apparatus are becoming predominant. Along with this trend, the latent image formation by using laser beam is predominant together with a requirement for higher resolution. Accordingly, similarly as in printers, higher resolution and higher definition developing scheme is being required. For complying with such demands, smaller particle size toners having a specific particle size distribution have been proposed in, e.g., JP-A 1-112253, JP-A 1-191156, JP-A 2-214156, JP-A 2-284158, JP-A 3-181952, and JP-A 4-162048.

On the other hand, in recent years when environmental protection is thought much of, a conventional primary charging and transfer process utilizing corona discharge is being gradually shifted to a primary charging and transfer process using a charging member abutted against an electrostatic image-bearing member.

More specifically, in the conventional primary changing and transfer process utilizing corona discharge, a substantial amount of ozone is generated at the time of corona discharge, particularly for generating negative corona, so that an image forming apparatus has to be equipped with a filter for ozone capture, which has required a larger apparatus size and an increased running cost. Such a corona charging scheme has also caused image defects, such as the so-called image flow caused by a lowering in surface resistivity of the photosensitive member due to attachment f ozone adducts, such as nitrogen oxide, and memory of the photosensitive member caused by ions remaining within the charger during the intermission of the image forming apparatus.

For solving the above-mentioned problems encountered in the corona charging system, a contact charging system or a contact transfer system has been developed, wherein a charging member or a transfer member in the form of, e.g., a roller or a blade, is caused to contact a photosensitive member surface to form a narrow space in proximity to the contact portion and cause a discharge presumably according to the Paschen's law, thereby suppressing the occurrence of ozone to the minimum, e.g., as disclosed in JP-A 57-178257, JP-A 56-104351, JP-A 58-40566, JP-A 58-139156, and JP-A 58-150975. Particularly, a charging scheme and a transfer scheme using an electro-conductive elastic roller as disclosed in JP-A 63-149669 and JP-A 2-123385 have been preferably used in view of the stability.

However, it has been also found that the contact charging system or the contact transfer system is accompanied with a problem to be considered not encountered in the corona discharge system.

More specifically, first in the contact transfer system wherein a transfer member is pressed against a photosensitive member via a transfer paper (i.e., transfer receiving material), at the time of transfer of a toner image on the photosensitive member to the transfer paper, the toner image is compressed thereby to cause a partial transfer failure so-called "hollow image" or "transfer dropout". Further, as the toner particle size is reduced for complying with a recent demand for a higher resolution and higher definition developing scheme, the forces of attaching toner particles onto the photosensitive member (such as image force and Van der Waals force) become predominant compared with Coulomb force acting on the toner particles for transfer, whereby the transfer residual toner is liable to be increased or the transfer failure is liable to be more serious.

On the other hand, in the contact charging system wherein a charging member is pressed against a photosensitive member surface at a certain pressure, the transfer residual toner is pressed against the photosensitive member surface, so that the photosensitive member surface is liable to be abraded and the toner melt-sticking is liable to be caused at the part of abrasion as a nucleus. This tendency becomes particularly noticeable if the amount of the transfer residual toner is increased.

The occurrence of the abrasion of and toner melt-sticking onto the photosensitive member causes serious defects in electrostatic image formation on the photosensitive member. More specifically, the abrasion of photosensitive member causes a failure of primary charging, so that the part of abrasion results in a black trace in a halftone image. The toner melt-sticking causes a failure of latent image formation by exposure, the part of melt-stuck toner results in a white trace in a halftone image. Further, these defects also deteriorate the toner transferability. Accordingly, in combination with the above-mentioned transfer failure caused by the contact transfer system, remarkable image defects are liable to occur, and the image quality deterioration can be accelerated synergistically in some cases.

The problems of the photosensitive member abrasion and transfer failure are liable to occur especially in the case of using a toner comprising indefinitely-shaped or non-spherical toner particles. This is presumably because of a lower transferability of the non-spherical toner particles and the presence of toner particle edges liable to scratch the photosensitive member surface. Further, the abrasion problem becomes severer in the case of using magnetic toner particles containing a magnetic material exposed to the surface thereof. This may be easily understood in view of a state that the exposed magnetic particles are directly pressed against the photosensitive member.

Further, when the amount of transfer residual toner is increased, it becomes difficult to retain sufficient contact between the contact charging member and the photosensitive member, so that the charging performance is lowered, thus being liable to cause a transfer of toner to non-image portion, i.e., fog in the case of reversal development. This difficulty is liable to be encountered in a low humidity environment wherein the resistivity of the charging member is increased.

As described above, in the image forming system including the contact charging system and the contact transfer system which are very preferable from an ecological viewpoint, it is desirable to develop and use a magnetic toner exhibiting high transferability and less liable to cause photosensitive member abrasion and toner melt-sticking.

On the other hand, in the case where some transfer residual toner remains after a transfer step of transferring a toner image formed on a photosensitive member in the developing step to a transfer-receiving material, the transfer residual toner has to be cleaned and recovered in a waste toner vessel in a cleaning step. In the cleaning step, a cleaning blade, a cleaning fur brush or a cleaning roller has been conventionally used. Any cleaning means has relied on mechanically scraping off or damming the transfer residual toner for recovery into the waste toner vessel. However, the use of such a mechanical cleaning means wears and shortens the life of the photosensitive member. From the apparatus viewpoint, the presence of cleaning device has posed an obstacle to provision of a compact apparatus. Further, from the viewpoints of ecology and effective toner utilization, a system free from generation of waste toner, i.e., a cleanerless system, is desirable.

Such cleanerless image forming systems have been discussed in JP-A 59-133573, JP-A 62-203182, JP-A 63-133179, JP-A 64-20587, JP-A 2-302772, JP-A 5-2289, JP-A 5-53482 and JP-A 5-61383. Moreover, a serious attention has not been paid to a desirable toner organization to be used in such cleanerless image forming systems.

JP-A 61-279864 has proposed a toner having specific shape factors SF-1 and SF-2, no reference is made to a transfer step using the toner. Further, as a trace experiment of ours, the toner exhibited a toner efficiency which is low and therefore has left a room for improvement.

JP-A 63-235953 has disclosed a magnetic toner sphered by mechanical impact, but the transfer efficiency thereof is still low and has left a room for further improvement.

Incidentally, a cleanerless image forming system including a simultaneous developing and cleaning scheme, a photosensitive member surface is rubbed with a toner and a toner-carrying member for recovering a toner on a non-image portion and supplying a toner to an image portion on the photosensitive member by the toner-carrying member. At the time of rubbing, if reversibly charged toners inclusive of transfer residual toner and fog toner can be oppositely charged to a normal polarity, such toners can be potentially easily recovered.

As a result of our study, in case where a conventional toner containing a magnetic material is used in such an image forming system including a simultaneous developing and cleaning scheme, a partial electrical continuity is caused at the time of developing between the photosensitive member and the tone-carrying member via the toner due to the magnetic material exposed to the toner particle surface, so that the electrostatic latent image on the photosensitive member is disturbed thereby and it is difficult to obtain a high definition image. Further, such a magnetic toner containing a magnetic material exposed to the toner particle surface causes an insufficient charge of the transfer residual toner, so that the smooth recovery thereof from the photosensitive member during the developing step is obstructed. Further, at the time of rubbing of the photosensitive member with the toner and the toner-carrying member, the photosensitive member is liable to be severely worn due to the magnetic material exposed to toner particle surface, thus shortening the life of the photosensitive member. As a result, there results in a so-called ghost image, i.e., a soiling toner images attached onto a non-image region.

Accordingly, in an image forming system including a simultaneous developing and cleaning scheme, a magnetic material-containing toner is desired to be free from exposure of the magnetic material to the toner particle surface.

Further, in an image forming system retaining a cleaning member while including a simultaneous developing and cleaning scheme, if the abutting pressing of the cleaning member against the photosensitive member is lowered in order to retain a longer life of the photosensitive member, an increased amount of the transfer residual toner can slip by the cleaning member to reach the developing step. In such a system, it is also very important to minimize the amount of the transfer residual toner stipping by the cleaning member even under a reduced abutting pressure of the cleaning member.

The above-mentioned problems encountered in the case of using a conventional magnetic material-containing magnetic toner have been principally caused by the exposure of the magnetic material to the toner particle surface. As another factor, in the case of a magnetic toner containing a magnetic material exposed to the toner particle surface, the magnetic toner is liable to have an unstable chargeability in a high humidity environment due to a lower resistivity of the magnetic material than the toner binder resin, thus causing difficulties, such as increased fog, lower transferability and a lower recovery rate of the transfer residual toner leading to the occurrence of ghost images, in addition to the performance deterioration of the photosensitive member due to abrasion of the photosensitive member by rubbing with the exposed magnetic material.

In view of the above factors, a magnetic toner exhibiting good initial performances and stability of performances in an image forming system including a simultaneous developing and cleaning scheme has not been obtained as yet.

SUMMARY OF THE INVENTION

A generic object of the present invention is to provide a toner and an image forming method having solved the above-mentioned problems of the prior art.

A more specific object of the present invention is to provide a magnetic toner which exhibits stable chargeability, less susceptible of environmental changes, and can provide images having high image density and with suppressed fog at a good image reproducibility even after a long period of continual use.

Another object of the present invention is to provide an image forming method which has solved the above-mentioned problems in the image forming process based on the contact development-scheme capable of omitting a cleaner system and can provide images free from fog and ghost with excellent resolution, transferability and excellent durability without being affected by environmental conditions.

Another object of the present invention is to provide an image forming method including a contact changing step of less ozone-generation type and a non-contact developing method using a magnetic toner (mono-component developer) providing images with less fog, wherein a magnetic toner exhibiting good transferability to cause less transfer dropout and less transfer residual toner and less abrading the photosensitive member, thus being less liable to result in image defects even after a long period of continual use.

Another object of the present invention is to provide an image forming method capable of stable electrostatic latent image formation even in a low humidity environment and resulting in less image defects such as fog due to a lowering in chargeability in continuous image formation.

According to the present invention, there is provided a toner, comprising: toner particles each comprising at least a binder resin and iron oxide particles, wherein (i) the toner particles exhibit a carbon content (A) and an iron content (B) giving a ratio $B/A<0.001$ at surfaces of the toner particles as measured by X-ray photoelectron spectroscopy, (ii) the toner particles exhibit an average circularity of at least 0.970, and (iii) the toner particles contain at least 50% by number of toner particles satisfying $D/C \leqq 0.02$, wherein C denotes a projection area-equivalent circular diameter of each toner particle and D denotes a minimum distance of iron oxide particles from a surface of the toner particle, based on a sectional view of the toner particle as observed through a transmission electron microscope (TEM).

According to another aspect of the present invention, there is provided an image forming method, comprising:

a charging step of charging an electrostatic image-bearing member with a charging member receiving a voltage from an external voltage supply, an exposure step of exposing the electrostatic image-bearing member to form an electrostatic latent image thereon, a developing step of developing the electrostatic latent image with the above-mentioned toner carried on a toner-carrying member to form a toner image on the electrostatic image-bearing member, and a transfer step of transferring the toner image onto a transfer-receiving material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
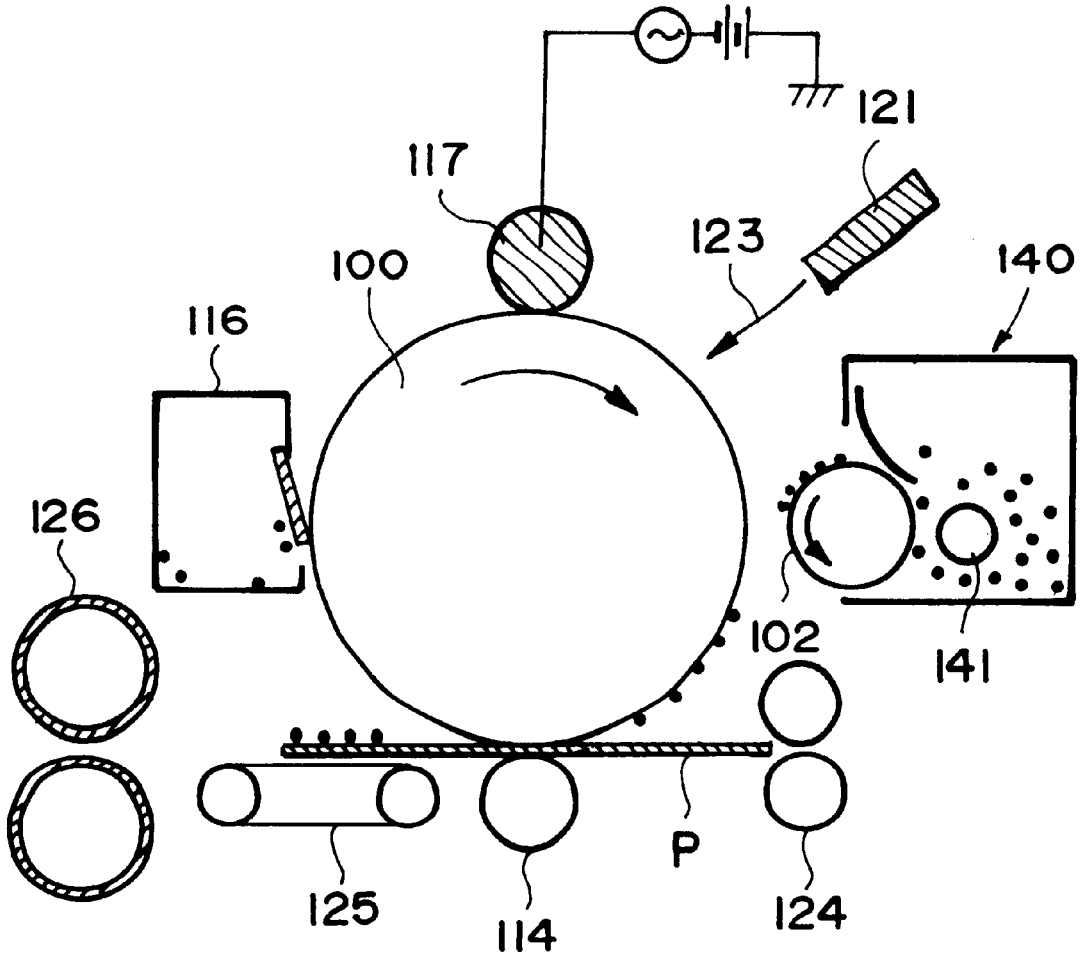
FIG. 1 is a schematic illustration of an image forming apparatus adopting a non-contact developing scheme.

As a result of our study regarding the uniformity and stability of chargeability of a magnetic toner, it has been found very effective to provide a magnetic toner satisfying the following properties (i) and (ii) in combination for realizing the uniform and stable chargeability.

(i) the toner particles exhibit a carbon content (A) and an iron content (B) giving a ratio B/A<0.001 at surfaces of the toner particles as measured by X-ray photoelectron spectroscopy, (ii) the toner particles exhibit an average circularity of at least 0.970, based on the following definition of circularity ø for each toner particle:

$$\text{circularity } \varnothing = L_0/L,$$

wherein $L_0$ denotes a peripheral length of a circle having an area equal to the projection area of the particle, and L denotes a peripheral length of the projection image of the particle.

Moreover, it has been found possible by using the magnetic toner to remarkably suppress the abrasion of a photosensitive member, insufficient charging, and transfer failure and stably provide high definition images free from image defects such as fog in a long period of use even in an image forming method including no cleaner but adopting a contact charging scheme wherein ghost images are liable to occur due to toner recovery failure, or an image forming method including a contact charging step, a monocomponent non-contact developing step and a contact transfer step.

The above properties (i) and (ii) have not been satisfied by conventional magnetic toners containing magnetic iron oxide. As a result of our detailed study, it has been discovered that the dissatisfaction of the properties is caused by failure in sufficient and uniform hydrophobization of magnetic iron oxide before inclusion into a magnetic toner.

In preparation of a magnetic toner, the dispersibility of magnetic iron oxide particles in a toner binder resin can be improved by using the magnetic iron oxide particles after surface hydrophobization. Further, even if a substantial amount of the magnetic iron oxide is exposed to the toner particle surfaces, the chargeability of the toner is less impaired in any environment, if the surface of the exposed magnetic iron oxide has been uniformly hydrophobized. This per se has been well known.

Accordingly, prior to the present invention, various methods for surface hydrophobization of magnetic iron oxide particles have been proposed. According to the methods proposed heretofore, however, it has not been easy to obtain magnetic iron oxide particles which have been sufficiently and uniformly hydrophobized. A higher hydrophobicity can be attained if a larger amount of hydrophobizing agent or a hydrophobizing agent having a higher viscosity is used. In this case, however, the coalescence of magnetic iron oxide fine particles is likely to occur, so that better hydrophobicity and better dispersion has not been necessarily achieved in combination.

Further to say, untreated magnetic iron oxide surface is generally hydrophillic, it is necessary to hydrophobize such a hydrophillic iron oxide in order to obtain a hydrophobic iron oxide. According to surface treating methods proposed heretofore, the uniformity of the resultant hydrophobicity has been insufficient, a conventional magnetic toner using such hydrophobized magnetic iron oxide is caused to have a chargeability which varies depending on humidity, etc., and is not sufficiently stable.

In contrast thereto, the iron oxide used as a magnetic material in the toner of the present invention has been provided with a very high level of uniform hydrophobicity. This is for example achieved by effecting a hydrophobization surface treatment while causing hydrolysis of a coupling agent (i.e., hydrophobizing agent) in an aqueous medium wherein magnetic iron oxide particles are dispersed in primary particles. Compared with gaseous phase treatment, such hydrophobization treatment in an aqueous medium is less liable to cause coalescence of magnetic iron oxide particles so that the iron oxide can be surface-treated in a substantially primary particle state, thereby achieving the hydrophobization at a high uniformity level.

Moreover, the method of surface treating iron oxide while causing hydrolysis of a coupling agent does not necessitate the use of a gas-generating coupling agent, such as chlorosilanes and silazanes, but allows the use of a high-viscosity coupling agent which has been difficult to use in a gaseous phase treatment because it is liable to cause the coalescence of magnetic iron oxide particles.

The coupling agents usable in the present invention may include, for example, silane coupling agents and titanate coupling agents. Silane coupling agents are preferred, as represented by a general formula of $R_mSiY_n$, wherein R denotes an alkoxy group; m denotes an integer of 1–3; Y denotes a hydrocarbon group such as alkyl, vinyl, glycidoxy or methacryl; and n denotes an integer of 1–3. Specific examples thereof may include: vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is particularly prefered to use an alkyltrialkoxysilane coupling agent represented by the following formula for hydrophobizing iron oxide in an aqueous medium.

$$C_pH_{2p+1}—Si(OC_qH_{2q+1})_3,$$

wherein p denotes an integer of 2–20, and q denotes an integer of 1–3.

In the above formula, if p is smaller than 2, the hydrophobization treatment becomes easier, but it becomes difficult to impart a sufficient hydrophobicity. On the other hand, if p is larger than 20, a sufficient hydrophobicity can be imparted, but the coalescence of iron oxide particles is liable to occur so that it becomes difficult to disperse the treated iron oxide particles in the toner.

Further, if q is larger than 3, the silane coupling agent is caused to have a lower reactivity, so that sufficient hydrophobization becomes difficult.

It is particularly preferred to use an alkyltrialkoxysilane represented by the above formula wherein p is an integer of 2–20, more preferably 3–15, and q is an integer of 1–3, more preferably 1 or 2.

The coupling agent may preferably be used for treatment in an amount of 0.05–20 wt. parts, more preferably 0.1–10 wt. parts, per 100 wt. parts of iron oxide.

The aqueous medium used for the hydrophobization treatment in the present invention refers to a dispersion medium principally comprising water. Specific examples of the aqueous medium may include: water per se, a mixture of water with a minor amount of surfactant, water containing a pH controlling agent, and a mixture of water with an organic solvent. The surfactant may preferably be a nonionic surfactant, such as polyvinyl alcohol. The surfactant may be added in 0.1–5 wt. % in water. The pH controlling agent may for example be an inorganic acid, such as hydrochloric acid.

The hydrophobization treatment may preferably be performed under sufficient stirring so as to disperse the iron oxide particles in particles within the aqueous medium, e.g., by means of a mixer having stirring blades, preferably a high-shearing force mixer, such as Attritor and TK-Homomixer.

The thus-treated iron oxide particles have been uniformly surface-hydrophobized and therefore can be very well dispersed in the toner binder resin, thus providing toner particles of which the surface is free from exposure of the iron oxide particles. As a result of using such treated iron oxide, it becomes possible to obtain the toner of the present invention characterized by the feature (i) that the toner particles exhibit a carbon content (A) and an iron content (B) giving a ratio B/A<0.001 at surfaces of the toner particles as measured by X-ray photoelectron spectroscopy whereby the toner is provided with uniform and stable chargeability for achieving high-quality image forming performances and highly stable continuous image forming performances. If the ratio B/A is below 0.0005, the uniform and stable chargeability is further improved.

More specifically, the iron oxide used in the present invention may for example be produced through a process as described belows.

To a ferrous salt aqueous solution, an alkali, such as sodium hydroxide, in an amount equivalent to the iron in the ferrous salt or larger to prepare an aqueous solution containing ferrous hydroxide. While retaining the pH of the thus-prepared aqueous solution at pH 7, preferably pH 8–10 and warming the aqueous solution at a temperature of 70° C. or higher, air is blown into the aqueous solution to oxidize the ferrous hydroxide, thereby first forming seed crystals functioning as nuclei of magnetic iron oxide particles to be produced.

Then, to the slurry-form liquid containing the seed crystals, an aqueous solution containing ferrous salt in an amount of ca. 1 equivalent based on the amount of the previously added alkali, is added. While keeping the liquid at pH 6–10, air is blown thereinto to proceed with the reaction of the ferrous hydroxide, thereby growing magnetic iron oxide particles around the seed crystals as nuclei. Along with the progress of the oxidation reaction, the liquid pH is shifted toward an acidic side, but it is preferred not to allow the liquid pH go down to below 6. At a final stage of the oxidation, the liquid pH is adjusted, and the slurry liquid is sufficiently stirred so as to disperse the magnetic iron oxide in primary particles. In this state, a coupling agent for hydrophobization is added to the liquid to be sufficiently mixed under stirring. Thereafter, the slurry is filtered out and dried, and the dried product is lightly disintegrated to provide hydrophobic treated magnetic iron oxide particles. Alternatively, the iron oxide particles after the oxidation reaction may be washed, filtered out and then, without being dried, re-dispersed in another aqueous medium. Then, the pH of the re-dispersion liquid is adjusted and subjected to hydrophobization by adding a coupling agent under sufficient stirring.

Magnetic iron oxide particles are produced by adding an alkali to an aqueous ferrous salt solution, oxidizing the ferrous salt at an elevated temperature, and further adding an aqueous ferrous salt solution.

Anyway, it is important that untreated iron oxide particles formed in the oxidation reaction system is subjected to hydrophobization in its wet slurry state and without being dried prior to the hydrophobization. This is because if the untreated iron oxide particles are dried as they are, the primary particles thereof are inevitably coalesced or agglomerated to some extent. It is difficult or substantially impossible to effect uniform hydrophobization of magnetic iron oxide particles, if such partially coalesced or agglomerated magnetic iron oxide particles are subjected to a hydrophobization treatment even in a wet system, thus failing to provide uniformly hydrophobized magnetic iron oxide particles giving toner particles satisfying B/A<0.001, as a characteristic of the toner according to the present invention.

As the ferrous salt used in the above-mentioned production process, it is generally possible to use ferrous sulfate by-produced in the sulfuric acid process for titanium production or ferrous sulfate by-produced during surface washing of steel sheets. It is also possible to use ferrous chloride.

In the above-mentioned process for producing magnetic iron oxide from a ferrous salt aqueous solution, a ferrous salt concentration of 0.5–2 mol/liter is generally used so as to obviate an excessive viscosity increase accompanying the reaction and in view of the solubility of a ferrous salt, particularly of ferrous sulfate. A lower ferrous salt concentration generally tends to provide finer magnetic iron oxide particles. Further, as for the reaction conditions, a higher rate of air supply, and a lower reaction temperature, tend to provide finer product particles.

By using the thus-produced hydrophobic magnetic iron oxide particles for toner production, it becomes possible to obtain the toner exhibiting excellent image forming performances and stability according to the present invention.

Incidentally, JP-B 60-3181 discloses a process for producing a magnetic polymerization toner containing magnetic particles which have been hydrophobized by surface treatment with a silane coupling agent in a wet system. However, the wet surface treatment with a silane coupling agent is applied to dry powdery untreated magnetic particles. Such dry magnetic fine particles have inevitably caused coalescence of particles by agglomeration during the drying step, so that uniform hydrophobization of individual magnetic particles is difficult even by a wet-system surface treatment. Even if a polymerization toner is produced by using such surface-treated magnetic particles, it is difficult to achieve a ratio B/A<0.001, a characteristic of the toner according to the present invention.

It is another important feature of the toner according to the present invention that (iii) the toner particles contain at least 50% by number of toner particles satisfying D/C≦0.02, wherein C denotes a projection area-equivalent circular diameter of each toner particle and D denotes a minimum distance of iron oxide particles from a surface of the toner particle, based on a sectional view of the toner particle as observed through a transmission electron microscope (TEM). It is further preferred that the toner particles contain 65% or more by number, more preferably 75% or more by number, of toner particles satisfying the relationship of D/C≦0.02.

If below 50% by number of toner particles satisfy the relationship of D/C≦0.02, this means that a major proportion of toner particles contain no ion oxide particles in a superficial region outside the boundary line defined by D/C=0.02. If such a toner particle is assumed to have a true spherical region, the iron oxide-free superficial region occupies at least 11.5% by volume of the toner particle. In an actual toner particle, the iron oxide particles inside the superficial region do not form a core region uniformly packed with the iron oxide particles, so that the iron oxide-free superficial region for such a toner particle clearly occupies more than 12% by volume. A toner composed of a major proportion of such toner particles having a substantial volume of iron oxide-free superficial region is therefore accompanied with several difficulties as mentioned before, such as incapability of incorporating a sufficient amount of iron oxide particles and a larger difference in developing and transfer performances depending on toner particle sizes.

The D/C values discussed herein are based on values measured in the following manner. Sample toner particles are sufficiently dispersed in a cold-setting epoxy resin, which is then hardened at 40° C. for 2 days. The hardened product is sliced, as it is or a further frozen state, into thin flakes by a microtome having a diamond cutter.

The thus-obtained thin flakes are photographed at a magnification of $1\times10^4$ through a transmission electron microscope (TEM) (Model "H-600", available from Hitachi K.K.) under an acceleration voltage of 100 kV. On the thus-taken photographs, toner particles having provided sectional views (areas) giving a circle-equivalent diameter (C) falling within a range of ±10% of the number-average particle size (determined according to the Coulter counter method described hereinafter) of the sample toner particles are taken for determination of a minimum distance (D) of iron oxide particles (having a particle size of at least 0.03 μm) in a toner particle from the surface of the toner particle to calculate a value D/C of the toner particle. From the measured values of D/C for a statistically sufficient number of toner particle sectional views, the percentage by number of toner particles giving D/C≦0.02 is determined for the sample toner particles.

A toner satisfying (i) B/A<0.001 and (iii) at least 50% by number of toner particles satisfying D/C≦0.02, means a toner which is free from localization of the iron oxide at the toner particle surface and also free from extreme localization of the iron oxide at the core, i.e., a toner comprising toner particles wherein the iron oxide is substantially uniformly dispersed but the surface exposure thereof is effectively suppressed. These requirements (i) and (iii) of the present invention cannot be satisfied by a non-uniform distribution of the iron oxide in the toner particles.

If the toner according to the present invention comprising toner particles substantially free from the surface exposure of iron oxide particles (i.e., satisfying (i) B/A<0.001), the surface abrasion of a photosensitive member is substantially prevented, and the surface abrasion and toner sticking onto the photosensitive member can be remarkably reduced over a long period of operation even in an image forming system wherein the toner is pressed against a photosensitive member by a charging member, a transfer member, etc.

The above-mentioned hydrophobized iron oxide may preferably be used in amount of 10–200 wt. parts, more preferably 20–180 wt. parts, per 100 wt. parts of the binder resin in the toner of the present invention. If the iron oxide is below 10 wt. parts, the coloring power of the toner is liable to be insufficient, and the suppression of fog becomes difficult. On the other hand, above 200 wt. parts, the toner is held onto the toner-carrying member under an excessively large magnetic holding force to exhibit a lower developing performance. Moreover, the uniform dispersion of the iron oxide particles in toner particles becomes difficult, and the fixability is liable to be lowered.

The toner according to the present invention is also characterize by a specifically high circularity. In order to reduce the toner attachment onto a non-image part and the transfer residual toner on the photosensitive member, it is necessary that the toner particles are charged sufficiently and uniformly. Further, in the case of using a small particle size toner exhibiting a large attachment force of toner particles from the viewpoint of higher image quality. The toner particle shape also greatly affects the toner attachment force onto the non-image part. More specifically, if toner particles have shapes which are closer to a sphere and more uniform, the toner particles are caused to have smaller attachment areas, thus reducing the amounts of toner attached not the non-image part and transfer residual toner on the photosensitive member, thus achieving higher image quality and stabler continuous image forming performances.

In view of these factors, the toner according to the present invention is required to have an average circularity of at least 0.97 for achieving the high image quality and high stability.

As a result, the toner of the present invention exhibits a reduced toner attachment force. Because of the reduced attachment force and the above-mentioned stable chargeability, the toner according to the present invention exhibits a remarkably improved efficiency of transfer from the photosensitive member to a transfer-receiving material, such as paper. This is an important toner performance for achieving a high resolution in addition to a minute dot image reproducibility.

Accordingly, by using a spherical toner according to the present invention, the amount of transfer residual toner is remarkably reduced. As a result, even in an image forming material including a contact charging step, the amount of toner present at an abutting part between the charging member and the photosensitive member is reduced, so that the abrasion of and toner melt-sticking onto the photosensitive member may be prevented to remarkably reduce image defects corresponding thereto. Further, toner particles exhibiting an average circularity of 0.970 or higher according to the present invention are substantially free from surface edge parts, so that they do not substantially scratch the photosensitive member surface even if they are present at the abutting position between the charging member and the photosensitive member, thereby suppressing the abrasion of the photosensitive member surface. These effects can also be remarkably exhibited in an image forming method including a contact transfer step wherein transfer dropout is liable to occur.

The toner according to the present invention may preferably have a weight-average particle size (D4) of 2–10 μm. Above 10 μm, the reproducibility of minute dot images is physically lowered so that the toner charge stability in a severe environment according to the present invention cannot be fully utilized. On the other hand, below 2 μm, the toner flowability is liable to be lowered, even if the other features of the toner according to the present invention, such as sphericity and surface non-exposure of the iron oxide, are relied on so that difficulties such as fog and lower density are liable to occur due to the charging failure.

Thus, the toner according to the present invention can exhibit remarkable improvements as in charging stability and flowability over the conventional toners, in case where it has a weight-average particle size (D4) of 2–10 μm, preferably 3– 10 μm, more preferably 3.5–8.0 μm for further high image quality.

Examples of polymerizable monomers constituting a polymerizable monomer mixture may include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a toner with good developing performances and continuous image forming performances.

In a preferred embodiment, the toner according to the present invention may contain 0.5– 50 wt. % of a release agent. Ordinarily, a toner image formed on a photosensitive member is transferred onto a transfer-receiving material in a transfer step, and the toner image is then fixed onto the transfer-receiving material under application of an energy, such as heat, pressure, etc., to provide a semipermanent image. For the fixation, a hot roller fixation scheme is frequently used. As mentioned above, a toner having a weight-average particle size of at most 10 μm can provide a very high definition image, but such fine toner particles when transferred onto paper as a transfer-receiving material are liable to enter gaps between paper fibers, thus receiving insufficient heat energy from the heat-fixation roller to cause low-temperature offset. By incorporating an appropriate amount of wax as a release agent in the toner of the present invention, it becomes possible to effectively prevent the abrasion of the photosensitive member while satisfying high resolution and anti-offset property in combination.

Examples of the wax usable in the toner according to the present invention may include: petroleum waxes, such as paraffin wax, microcrystalline wax and petrolatum, and derivatives thereof; montan wax and derivatives thereof, hydrocarbon wax obtained through Fischer-Tropsche process and derivatives thereof, polyolefin waxes as represented by polyethylene wax and derivatives thereof, and natural waxes such as carnauba wax and candellila wax and derivatives thereof. The derivatives herein may include: oxides, block copolymers and graft-modified products with vinyl monomers. It is also possible to use higher aliphatic alcohols, aliphatic acids such as stearic acid and palmitic acid and derivatives thereof, acid amide wax, ester wax, ketone, hardened castor oil and derivatives thereof, negative waxes and animal waxes.

Among these waxes, those providing a DSC curve on temperature increase (as measured by using a differential scanning calorimeter) showing a maximum heat-absorption peak in a range of 40–110° C., particularly 45–90° C., are preferred. A wax satisfying the above feature may effectively develop releasability while remarkably improving the low-temperature fixability. If the maximum heat-absorption peak appears at below 40° C., the wax exhibits only weak self cohesion, thus resulting in inferior anti-high temperature offset property. On the other hand, if the maximum heat-absorption peak appears at above 110° C., the fixation temperature becomes high and low-temperature offset is liable to occur. In the case of polymerization toner production in an aqueous medium, if the maximum heat-absorption temperature is high, the wax is liable to precipitate during dispersion of the polymerizable monomer mixture containing the wax in the aqueous medium.

The DSC measurement for determining the maximum heat-absorption peak temperature of a wax component may be performed according to ASTM D3418-8 by using, e.g., "DSC-7" available from Perkin-Elmer Corp. Temperature compensation of the detector unit may be performed based on melting points of indium and zinc, and caloric calibration may be made based on the fusion heat of indium. For measurement, a sample is placed on an aluminum pan and heated at a rate of 10° C./min. together with a blank pan as a control.

The wax component may preferably be contained in 0.5–50 wt. % of the binder resin. Below 0.5 wt. %, the low-temperature offset suppression effect is scarce. Above 50 wt. %, the long-term storability of the toner is lowered, and the dispersibility of other toner ingredients is lowered to result in inferior toner flowability and lower image forming performances.

In preparation of the toner of the present invention by polymerization, it is possible to incorporate a resin in the monomer mixture. For example, in order to introduce a polymer having a hydrophillic functional group, such as amino, carboxyl, hydroxyl, sulfonic acid, glicidyl or nitrile, of which the monomer is unsuitable to be used in an aqueous suspension system because of its water-solubility resulting in emulsion polymerization, such a polymer unit may be incorporated in the monomer mixture in the form of a copolymer (random, block or graft-copolymer) of the monomer with another vinyl monomer, such as styrene or ethylene; or a polycondensate, such as polyester or polyamide; or polyaddition-type polymer, such as polyether or polyimine. If a polymer having such a polar functional group is included in the monomer mixture to be incorporated in the product toner particles, the phase separation of the wax is promoted to enhance the encapsulation of the wax, thus providing a toner with better anti-offset property, anti-blocking property, and low-temperature fixability. Such a polar polymer may preferably be used in 1–20 wt. parts per 100 wt. parts of the polymerizable monomer. Below 1 wt. part, the addition effect is scarce, and above 20 wt. parts, the physical property designing of the resultant polymerization toner becomes difficult. The polymer having such a polar functional group may preferably have an average molecular weight of at least 3000. Below 3000, particularly below 2000, the polymer is excessively concentrated at the surface of the product toner particles to adversely affect the developing performance and anti-blocking property of the toner. On the other hand, if a polymer having a molecular weight different from the molecular weight range of the polymer resulting from polymerization of the monomer(s) is incorporated in the monomer mixture, the resultant toner may be provided with a broader molecular weight distribution favoring a higher anti-offset property.

The toner according to the present invention may contain a charge control agent for acquiring a stable chargeability. The charge control agent may be known one but may preferably be one providing a high charging speed and stably providing a constant charge.

Further, in the case of toner production through the polymerization process, it is particularly preferred to use a charge control agent which exhibits little polymerization inhibition effect and contains substantially no fraction soluble in the aqueous dispersion medium. Specific examples of such negative control agents may include: metal compounds of aromatic carboxylic acids, hydroxycarboxylic acids or dicarboxylic acids, such as salicylic acid, alkylsalicylic acids, dialkylsalicylic acid and naphthoic acid; metal salts or metal complexes of azo dyes or azo pigments; polymeric compounds having sulfonic acid or carboxylic acid group in their side chains, boron compounds, urea compounds, silicon compounds and calix arenes. Examples of positive charge control agents may include: quaternary ammonium salts, polymeric compounds having such a quaternary ammonium salt group in their side chains, guanidine compounds, nigrosine compounds and imidazole compounds. Such a charge control agent may preferably be contained in 0.5–10 wt. parts per 100 wt. parts of the binder resin. However, the inclusion of a charge control agent is not essential to the toner of the present invention. For example, the inclusion of a charge control agent can be omitted, if the toner is used in an image forming method wherein triboelectrification by friction with a toner layer regulation member or a toner-carrying member is positively used.

The iron oxide used as a magnetic material in the toner of the present invention may principally comprise triiron tetroxide or γ-iron oxide optionally containing one or more elements, such as phosphorus, cobalt, nickel, copper, magnesium, manganese, aluminum or silicon. The iron oxide particles may preferably have a BET specific surface area of 2–30 $m^2/g$, more preferably 3–28 $m^2/g$, and a Moh's hardness of 5–7.

The iron oxide particles may have octahedral, hexahedral, spherical, acicular or flaky shape, but iron oxide particles having less anisotropic shapes, such as octahedral, hexahedral, spherical or indefinite shape are preferred in order to provide a high image density. Such particle shapes may be confirmed by observation through a scanning electron microscope (SEM). It is preferred that the iron oxide particles have a volume-average particle size of 0.1–0.3 μm and contain at most 40% by number of particles of 0.03–0.1 μm, based on measurement of particles having particle sizes of at least 0.03 μm.

Iron oxide particles having an average particle size of below 0.1 μm are not generally preferred because they are liable to provide a magnetic toner giving images which are somewhat tinted in red and insufficient in blackness with enhanced reddish tint in halftone images. Further, as the iron oxide particles are caused to have an increased surface area, the dispersibility thereof is lowered, and an inefficiently larger energy is consumed for the production. Further, the coloring power of the iron oxide particles can be lowered to result in insufficient image density in some cases.

On the other hand, if the iron oxide particles have an average particle size in excess of 0.3 μm, the weight per one particle is increased to increase the probability of exposure thereof to the toner particle surface due to a specific gravity difference with the binder during the production. Further, the wearing of the production apparatus can be promoted and the dispersion thereof is liable to become unstable.

Further, if particles of 0.1 um or smaller exceed 40% by number of total particles (having particle sizes of 0.03 um or larger), the iron oxide particles are liable to have a lower dispersibility because of an increased surface area, liable to form agglomerates in the toner to impair the toner chargeability, and are liable to have a lower coloring power. If the percentage is lowered to at most 30% by number, the difficulties are preferably alleviated.

Incidentally, iron oxide particles having particle sizes of below 0.03 μm receive little stress during the toner production so that the probability of exposure thereof to the toner particle surface is low. Further, even if such minute particles are exposed to the toner particle surface, they do not substantially function as leakage sites lowering the chargeability of the toner particles. Accordingly, the particles of 0.03–0.1 μm are noted herein, and the percentage by number thereof is suppressed to below a certain limit.

On the other hand, if particles of 0.3 μm or larger exceed 10% by number, the iron oxide particles are caused to have a lower coloring power, thus being liable to result in a lower image density. Further, as the number of iron oxide particles is decreased at an identical weight percentage, it becomes difficult statistically to have the iron oxide particles be present up to the proximity of the toner particle surface and distribute equal numbers of iron oxide particles to respective toner particles. This is undesirable. It is further preferred that the percentage be suppressed to at most 5% by number.

In the present invention, it is preferred that the iron oxide production conditions are adjusted so as to satisfy the above-mentioned conditions for the particle size distribution, or the produced iron oxide particles are used for the toner production after adjusting the particle size distribution as by pulverization and/or classification. The classification may suitably be performed by utilizing sedimentation as by a centrifuge or a thickener, or wet classification using, e.g., a cyclone.

The volume-average particle size and particle size distribution of iron oxide particles described herein are based on values measured in the following manner.

Sample particles in a sufficiently dispersed state are photographed at a magnification of $3\times10^4$ through a transmission electron microscope (TEM), and 100 particles each having a particle size of at least 0.03 μm selected at random in visual fields of the taken photographs are subjected to measurement of projection areas. The particle size (projection area-equivalent circle diameter) of each particle is determined as a diameter of a circle having an area equal to the measured projection area of the particle. Based on the measured particle sizes of the 100 particles, a volume-average particle size, percentage by number of particles of 0.03 μm–0.1 μm and percentage by number of particles of 0.3 μm or larger are determined. Identical determination can also be made automatically by using an image analyzer.

The volume-average particle size and particle size distribution of iron oxide particles dispersed within toner particles may be measured in the following manner.

Sample toner particles are sufficiently dispersed in a cold-setting epoxy resin, which is then hardened for 2 days at 40° C. The hardened product is sliced into thin flakes by a microtome. The thin flakes are observed through a TEM and photographic at magnification of $1\times10^4$–$4\times10^4$. One hundred iron oxide particles of at least 0.03 μm in particle size selected at random in visual fields of the taken photographs are subjected to measurement of projection areas. From the projection areas of the 100 iron oxide particles, a volume-average particle size (projection area-equivalent circular diameter), percentage by number of particles of 0.03 μm–0.1 μm and percentage by number of particles of 0.3 μm or larger are determined similarly as the above.

The toner of the present invention can also contain another colorant in addition to the magnetic iron oxide. Examples of such another colorant may include: magnetic or non-magnetic inorganic compounds and known dyes and pigments. Specific examples thereof may include: particles of ferromagnetic metals, such as cobalt and nickel, alloys of these metals with chromium, manganese, copper, zinc, aluminum and rare earth elements, hematite, titanium black, nigrosine dye/pigment, carbon black and phthalocyanine. Such another colorant can also be surface-treated.

For the preparation of a polymerization toner, a polymerization initiator exhibiting a halflife of 0.5–30 hours at the polymerization temperature may be added in an amount of 0.5–20 wt. % of the polymerizable monomer so as to obtain a polymer exhibiting a maximum in a molecular weight range of $1\times10^4$–$1\times10^5$, thereby providing the toner with a desirable strength and appropriate melt-characteristics. Examples of the polymerization initiator may include: azo- or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobis-isobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The polymerizable monomer mixture can further contain a crosslinking agent in a proportion of preferably 0.001–15 wt. % of the polymerizable monomer.

In the toner production by suspension polymerization, a polymerizable monomer mixture is formed by mixing the polymerizable monomer and the iron oxide with other toner ingredients, as desired, such as a colorant, a release agent, a plasticizer, another polymer and a crosslinking agent, and further adding thereto other additives, such as an organic solvent for lowering the viscosity of the polymer produced in the polymerization, a dispersing agent, etc. The thus-obtained polymerizable monomer mixture is further subjected to uniform dissolution or dispersion by a dispersing means, such as a homogenizer, a ball mill, a colloid mill or an ultrasonic disperser, and then charged into and suspended in an aqueous medium containing a dispersion stabilizer. In this instance, if the suspension system is subjected to dispersion into a desired toner size without a break by using a high-speed dispersing machine, such as a high-speed stirrer or an ultrasonic disperser, the resultant toner particles are provided with a sharper particle size distribution. The polymerization initiator may be added to the polymerizable monomer together with other ingredients as described above or immediately before suspension into the aqueous medium. Alternatively, it is also possible to add the polymerization initiator as a solution thereof in the polymerizable monomer or a solvent to the suspension system immediately before the initiation of the polymerization.

After the particle or droplet formation by suspension in the above-described manner using a high-speed dispersion means, the system is stirred by an ordinary stirring device so as to retain the dispersed particle state and prevent the floating or sedimentation of the particles.

In the suspension polymerization process, a known surfactant, or organic or inorganic dispersant, may be used as the dispersion stabilizer. Among these, an inorganic dispersant may preferably be used because it is less liable to result in deleterious ultrafine powder, the resultant dispersion stability is less liable to be broken even at a reaction temperature change because the dispersion stabilization effect is attained by its stearic hindrance, and it is easily washed to be free from leaving adverse effect to the toner. Examples of the inorganic dispersant may include: polyvalent metal phosphates, such as calcium phosphate, magnesium phosphate, aluminum phosphate and zinc phosphate; carbonates, such as calcium carbonate and magnesium carbonate; inorganic salts, such as calcium metasilicate, calcium sulfate and barium sulfate; and inorganic oxides, such as calcium hydroxide, magnesium hydroxide, aluminum hydroxide, silica, bentonite and alumina.

These inorganic dispersant may be used singly or in combination of two or more species in 0.2–20 wt. parts per 100 wt. parts of the polymerizable monomer. In order to obtain toner particles having a further small average size of, e.g., at most 5 μm, it is also possible to use 0.001–0.1 wt. part of a surfactant in combination.

Examples of the surfactant may include: sodium dodecylbenzene sulfate, sodium tetradecyl sulfate, sodium pentadecyl sulfate, sodium octyl sulfate, sodium oleate, sodium laurate, sodium stearate, and potassium stearate.

Such an inorganic dispersant as described above may be used in a commercially available state as it is, but in order to obtain fine particles thereof, such an inorganic dispersant may be produced in an aqueous medium prior to dispersion of the polymerizable monomer mixture in the aqueous system. For example, in the case of calcium phosphate, sodium phosphate aqueous solution and calcium aqueous chloride aqueous solution may be blended under high-speed stirring to form water-insoluble calcium phosphate allowing more uniform and finer dispersion. At this time, water-soluble sodium chloride is by-produced, but the presence of a water-soluble salt is effective for suppressing the dissolution of a polymerizable monomer in the aqueous medium, thus suppressing the production of ultrafine toner particles due to emulsion polymerization, and thus being more convenient. The presence of a water-soluble salt however can obstruct the removal of the residual polymerizable monomer in the final stage of polymerization, so that it is advisable to exchange the aqueous medium or effect desalting with ion-exchange resin. The inorganic dispersant can be removed substantially completely by dissolution with acid or alkali after the polymerization.

In the polymerization step, the polymerization temperature may be set to at least 40° C., generally in the range of 50–90° C. By polymerization in this temperature range, the release agent or wax to be enclosed inside the toner particles may be precipitated by phase separation to allow a more complete enclosure. In order to consume a remaining portion of the polymerizable monomer, the reaction temperature may possibly be raised up to 90–150° C. in the final stage of polymerization.

The toner particles of the present invention may preferably be blended with inorganic fine powder or hydrophobized inorganic fine powder as a flowability-improving agent to provide the toner according to the present invention. Examples thereof may include: titanium oxide fine powder, silica fine powder and calcium fine powder. Silica-fine powder is particularly preferred.

Such inorganic fine powder may preferably exhibit a specific surface area of at least 30 $m^2/g$, particularly 50–400 $m^2/g$, as measured by the BET method according to nitrogen adsorption, so as to provide good results.

The silica fine powder used in the present invention may comprise either the dry-process silica or fumed silica formed by vapor-phase oxidation of silicon halides, or wet-process silica as produced from water glass. It is however preferred to use the dry-process silica accompanied with less surface or integral silanol group and with less production residue.

The silica fine powder used in the present invention should preferably be a hydrophobized one. The hydrophobization may be performed by chemically treating silica fine powder with an organic silicon compound, etc., reacting with or being adsorbed by the silica fine powder. As a preferred method, a dry-process silica fine powder formed by vapor-phase oxidation of a silicon halide may be treated with a silane coupling agent, and then or simultaneously therewith, treated with an organosilicon compound, such as silicone oil.

Examples of the silane coupling agent may include: hexamethyldisilazane, trimethylsilane, trimethylchlorosilane, trimthylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorislane, triorganosilane mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramthyldisiloxane, and 1,3-diphenyltetramethyldisiloxane.

As the organosilicon compound, silicone oil may be used. Silicone oil preferably used may have a viscosity of ca. 30–1000 $mm^2/s$ (cSt). Preferred examples thereof may include: dimethylsilicone oil, methylphenylsilicone oil, α-ethylstyrene-modified silicone oil, chlorophenylsilicone oil, and fluorine-containing silicone oil.

The treatment with a silicone oil may be performed by mixing base silica fine powder (already treated with or to be treated simultaneously with a silane coupling agent) with the silicone oil directly in a blender, such as a Henschel mixer, or spraying the silicone oil onto the base silica fine powder. Alternatively, it is also possible to apply a method wherein the silicone oil is dissolved or dispersed in an appropriate solvent, and the base silica fine powder is mixed therewith, followed by removal of the solvent.

The toner according to the present invention can further contain external additives other than the flowability improver, as desired.

For example, in order to improve the cleanability, it is possible to further add fine particles having a primary particle size exceeding 30 nm (and preferably also specific surface area of below 50 $m^2/g$), more preferably close-to-spherical inorganic or organic fine particles having a primary particle size of at least 50 nm (and preferably also a specific surface area of below 30 $m^2/g$), as a preferred mode. For example, it is preferred to use spherical silica particles, spherical polymethylsilsesquioxane particles or spherical resin particles.

Examples of other external additives may include: lubricant powder, such as polytetrafluoroethylene powder, zinc stearate powder, and polyvinylidene fluoride powder; abrasives, such as cerium oxide powder, silicon carbide powder and strontium titanate powder; anti-caking agents; and electroconductivity-imparting agents, such as carbon black powder, zinc oxide powder, and tin oxide powder. It is also possible to add a minor amount of opposite-polarity organic fine particles or inorganic fine particles as a developing improver. It is possible that these additives have been surface-hydrophobized.

The above-mentioned external additive, may be added in a proportion of 0.1–5 wt. parts, preferably 0.1–3 wt. parts, per 10 wt. parts of the toner.

In the case of producing the toner of the present invention through a pulverization process, a known process may be adopted. For example, essential ingredients of the toner including the binder resin, the iron oxide, a release agent, a charge control agent, and optionally, a colorant, and other additives, may be sufficiently blended in a mixing means, such as a Henschel mixer or a ball mill, and then melt-kneaded by a hot heating means, such as hot rollers, a kneader or an extruder, to melt-mixing the resins and disperse or dissolve other ingredients including the iron oxide in the resin. After cooling, the melt-kneaded product is pulverized, classified and optionally surface-treated to obtain toner particles, which are then blended with external additives such as a flowability improver to obtain the toner according to the present invention. The classification and the surface treatment can be performed in this order or in a reverse order. The classification may preferably be performed by using a multi-division classifier in view of the production efficiency.

The pulverization may be performed by using known pulverizing apparatus of the mechanical impact type or the jetting type. In order to attain a specific circularity of the toner of the present invention, it is preferred to effect the pulverization under heating or apply a supplementary mechanical impact. It is also possible to subject the toner particles after pulverization (and optionally further classification) to dispersion in a hot water bath or passage through a hot gas stream.

The application of a mechanical impact may be effected by using, e.g., "Kryptron" system (available from Kawasaki Jukogyo K.K.) or "Turbo Mill" (available from Turbo Kogyo K.K.). It is also possible to use a system wherein toner particles are directed toward a casing inner wall by blades rotating at a high speed so as apply a mechanical impact as by compression and friction to the toner particles, such as "Mechano-Fusion" system (available from Hosokawa Micron K.K.) or "Hybridization" system (available from Nara Kikai Seisakusho K.K.).

In the case of applying a mechanical impact as a surface treatment, the environment temperature for the treatment may preferably be set in the neighborhood of the glass transition point Tg of the toner (i.e., in a range of Tg±30° C.) from the viewpoint of prevention of agglomeration and productivity. The treatment in the temperature range of Tg±20° C. is further preferred so as to particularly effectively increase the transfer efficiency.

It is also possible to produce the toner of the present invention according to a method of using a disk or a multi-fluid nozzle for spraying the melt-mixture into the air to form spherical toner particles as disclosed in JP-B 56-13945; a method of directly producing toner particles through polymerization in an aqueous organic solvent wherein the monomer is soluble but the resultant polymer is insoluble; or an emulsion polymerization method as represented by a soap-free polymerization wherein toner particles are directly produced by polymerization in the presence of a water-soluble polymerization initiator.

Examples of the binder resin for producing the toner according to the present invention through the pulverization process may include: homopolymers of styrene and its substitution derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resin, aromatic petroleum resin, paraffin wax, and carnauba resin. These resins may be used singly or in mixture of two or more species. Styrene copolymers and polyester resins are particularly preferred in view of developing performances and fixability.

Figure 2:
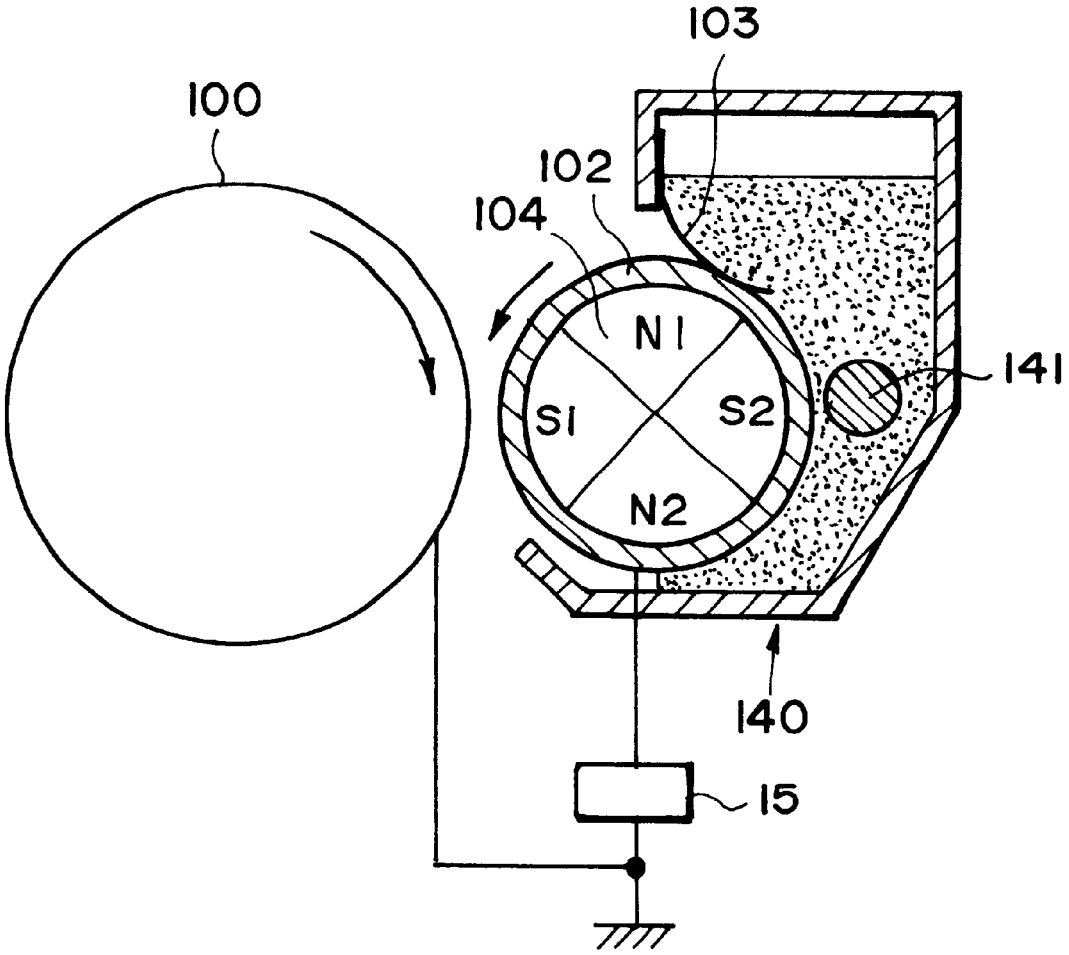
FIG. 2 is an enlarged view around a developing device included in the image forming apparatus of FIG. 1.

Next, a developing method using the toner according to the present invention will be described, first with respect to a system wherein a photo-sensitive member (an electrostatic image-bearing member) and a toner-carrying member do not contact with each other (as illustrated in FIGS. 1 and 2).

In such a non-contact developing system, a magnetic toner is applied in a toner-carrying member in a layer thickness smaller than a closest gap between the toner-carrying member and a photosensitive member to effect a development under application of an alternating bias electric field. Such a thin toner layer may be formed by using a toner layer thickness regulation member disposed above the toner-carrying member. In a preferred embodiment, an elastic toner layer thickness regulating means is abutted against the toner carrying member so as to uniformly charge the magnetic toner.

The toner-carrying member may preferably be disposed opposite to the photosensitive member with a spacing therefrom of 100–500 $\mu$m, more preferably 120–500 $\mu$m. Below 100 $\mu$m, the toner developing performance can be remarkably changed due to a fluctuation in spacing, so that it becomes difficult to produce image forming apparatus exhibiting stable image forming performances in a large scale. Above 500 $\mu$m, the followability of the toner onto a latent image on the photosensitive member is lowered to result in lower image qualities, such as a lower resolution and a lower image density. Moreover, in the case of a simultaneously developing and cleaning system, the efficiency of recovery of transfer residual toner is lowered to result in foggy images due to toner recovery failure.

The toner layer may preferably be formed at a rate of 5–30 g/m$^2$ on the toner-carrying member. Below 5 g/m$^2$, it becomes difficult to attain a sufficient image density, and because of excessive toner charge, the toner layer is liable to be accompanied with a coating irregularity. Above 30 g/m$^2$, toner scattering is liable to be caused.

The toner carrying member may preferably have a surface roughness Ra (JIS centerline-average roughness) in the range of 0.2–3.5 $\mu$m. If Ra is below 0.2 $\mu$m, the toner on the toner-carrying member is liable to be excessively charged, thus exhibiting insufficient developing performance. Above 3.5 $\mu$m, the toner layer on the toner-carrying member is liable to cause coating irregularity, thus resulting in density irregularity on the resultant images. The surface roughness may further preferably be in the range of 0.5–3.0 $\mu$m.

The surface roughness Ra of the toner carrying member refers to a center line-average roughness as measured by a surface roughness tester ("SURFCODER SE-30H", available from K.K. Kosaka Kenkyusho) according to JIS B0601. More specifically, the surface roughness Ra may be determined by taking a measurement length a of 2.5 mm along a center line (taken on an x-axis) and taking a roughness on a y-axis direction to represent the roughness curve by a function of y=f(x) to calculate a surface roughness Ra ($\mu$m) from the following equation:

$$Ra=(1/a)\int_0^a |f(x)|dx.$$

The magnetic toner according to the present invention has a high chargeability, so that a total charge thereof should preferably be controlled at the time of development. Accordingly, the toner-carrying member may preferably be surface-coated with a layer of resin in which electroconductive fine particles and/or a lubricant is dispersed.

The electroconductive fine particles contained in the coating resin layer on the toner-carrying member may preferably comprise one species or a combination of two or more species selected from carbon black, graphite, and electroconductive metal oxides or metal complex oxides, such as electroconductive zinc oxide. The coating resin for dispersion of the electroconductive fine particles and/or lubricant may comprise a known resin, such as phenolic resin, epoxy resin, polyamide resin, polyester resin, polycarbonate resin, polyolefine resin, silicone resin, fluorine-containing resin, styrene resin, or acrylic resin. A thermosetting resin or photosetting resin is particularly preferred.

In the non-contact developing method, the moving speed (surface speed) of the toner-carrying member carrying and conveying the toner thereon may preferably be different from that of the photosensitive member in the developing region. By providing such a moving speed difference, the toner particles can be sufficiently supplied from the toner-carrying member to the photosensitive member, thus providing good images.

The toner-carrying member surface can move in an identical direction or a reverse direction with respect to the surface moving direction of the photosensitive member, preferably at a relative speed of 1.02–3.0 times.

The development is performed by transferring the magnetic toner under application of an alternating bias electric field onto an electrostatic latent image. The alternating bias electric field may preferably comprise a peak-to-peak electric field intensity of $3\times10^6$–$1\times10^7$ V/m and a frequency of 100– 500 Hz. It is also preferred to superpose a DC bias electric field thereon.

Figure 3:
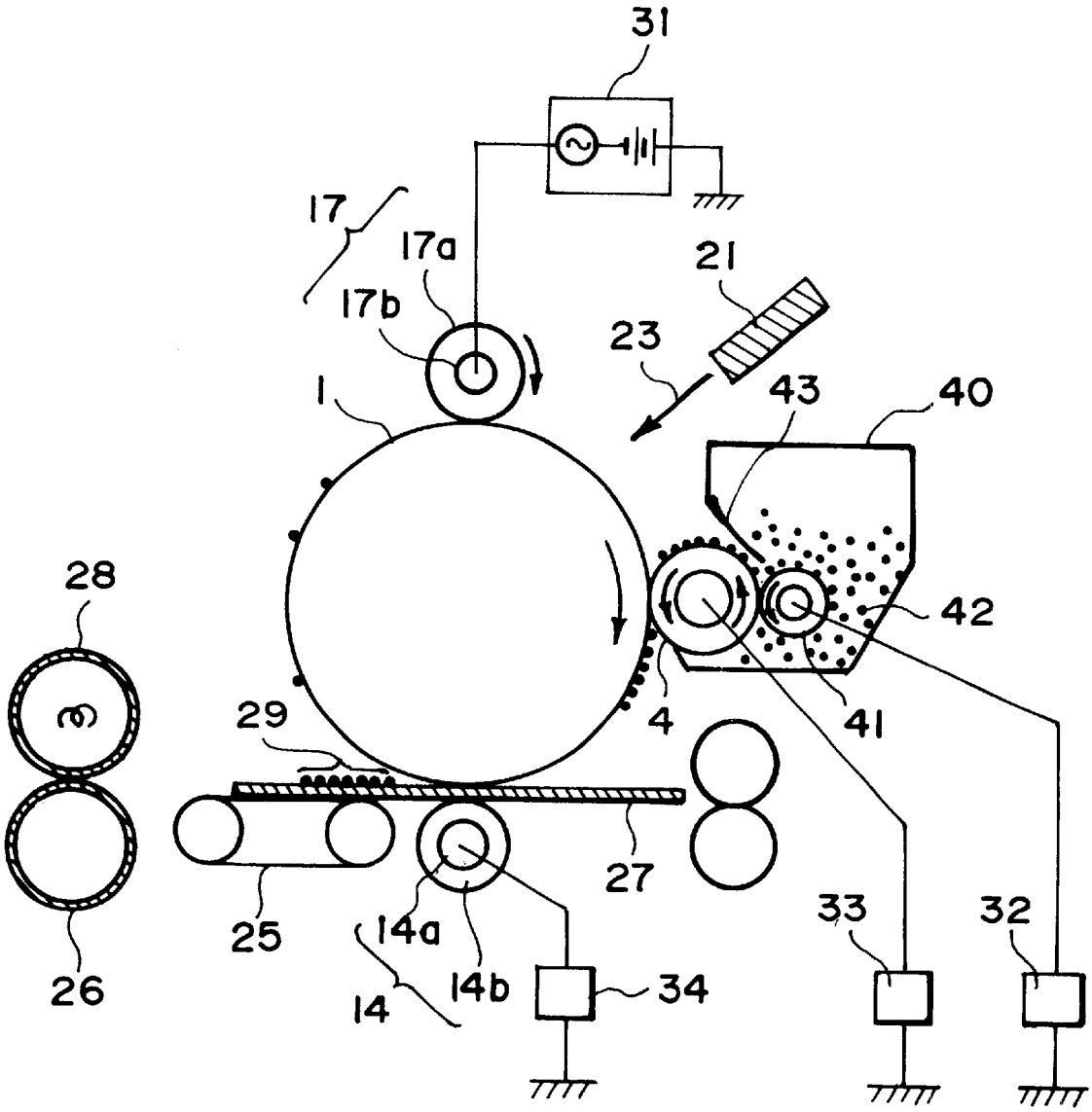
FIG. 3 is a schematic illustration of an image forming apparatus adopting a contact developing scheme.
Figure 4:
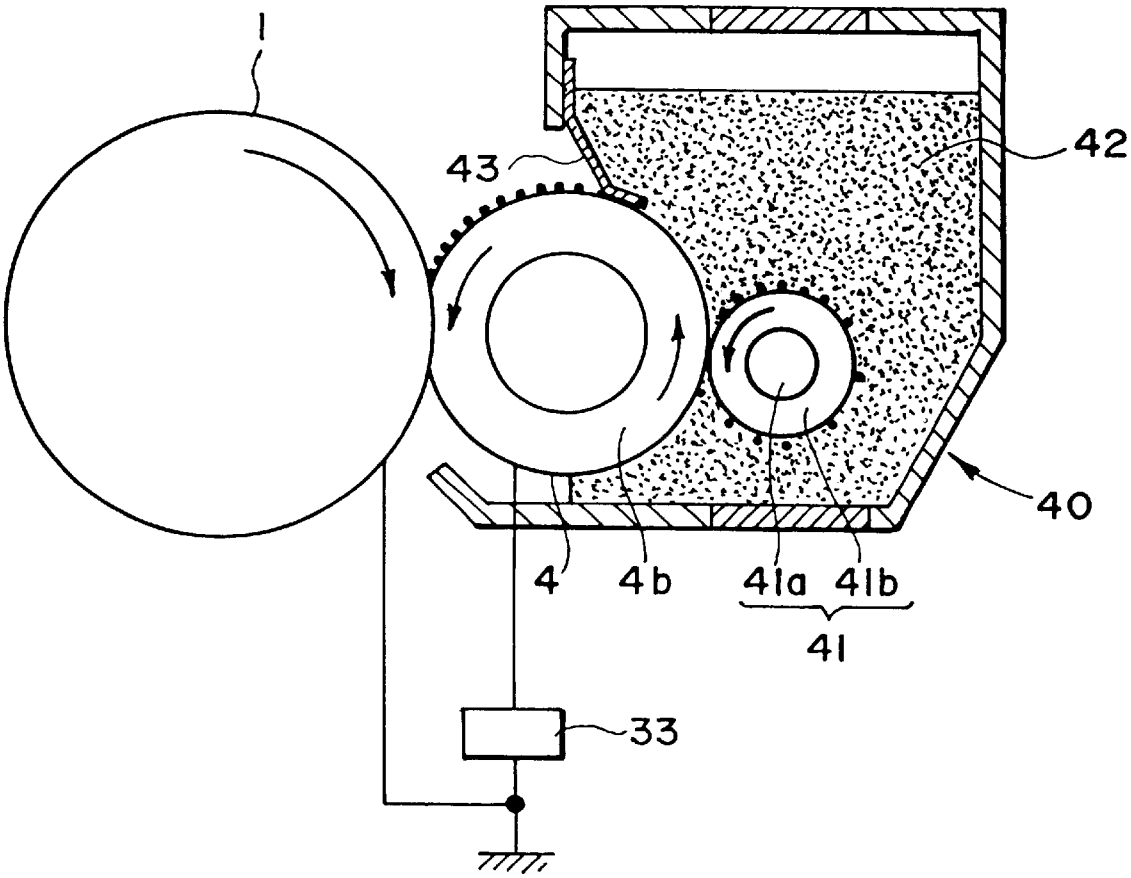
FIG. 4 is an enlarged view around a developing device included in the image forming apparatus of FIG. 3.

Next, a system wherein a toner-carrying member and a photosensitive member (electrostatic image-bearing member) contact each other for development (as illustrated in FIGS. 3 and 4) will be described.

In such a contact developing system, a reversal development mode is preferred. It is also preferred to adopt a simultaneous developing and cleaning scheme, so as to allow a substantial reduction in size of entire apparatus. In this instance, a DC or AC bias electric field may be applied at the time of development in a blank period before or after the development so as to provide a controlled potential allowing the development and the recovery of residual toner on the photosensitive member. The DC component is set between the bright-part potential and the dark-part potential.

The toner-carrying member may preferably comprise an elastic roller, on which the toner is applied to contact the photosensitive member surface. In this instance, as the development is effected by an electric field acting between the photosensitive member and the elastic roller via the toner, it is necessary that a potential is present at the surface of or in the vicinity thereof of the elastic roller, and an electric field is formed across a narrow gap between the photosensitive member surface and the elastic roller surface. For this purpose, it is possible to use an elastic roller having an elastomer layer of a medium region of controlled resistivity to retain an electric field while preventing the continuity with the photosensitive member surface, or an electroconductive roller coated with a thin surface insulating layer. Alternatively, it is also possible to use an electroconductive resin sleeve having an insulating substance layer on its surface facing the photosensitive member or an insulating sleeve having an electroconductive layer on its surface not facing the photosensitive member. It is also possible to use a toner-carrying member in the form of a rigid roller in combination with a photosensitive member in the form of a flexible belt. The elastic roller as a toner-carrying member may preferably have a resistivity in the range of $10^2$–$10^9$ ohm.cm.

The toner-carrying member may preferably have a surface roughness Ra in the range of 0.2–3.0 $\mu$m so as to satisfy a high image quality and a high durability. If Ra exceeds 3.0 $\mu$m, the thin toner layer formation on the toner-carrying member becomes difficult, and the toner charging performance is not improved, so that in improved image quality cannot be expected. If the Ra is set to be 3.0 $\mu$m or below, the toner-conveying performance on the toner-carrying member surface is suppressed, and as a thin toner layer is formed thereon, the frequency of contact between the toner and the toner-carrying member is increased to improve the toner charging performance. As a synergy of these effects, the image quality is improved. On the other hand, if Ra is below 0.2 $\mu$m, the control of toner coating amount becomes difficult.

In the contact developing method, the toner-carrying member surface may be moved either in an identical direction or in a reverse direction with respect to the photosensitive member. In the case of movement in identical direction, the toner-carrying member may preferably be moved (or rotated) at a circumferential speed which is 1.05–3.0 times that of the photosensitive member.

If the circumferential speed of the toner-carrying member is below 1.05 times that of the photosensitive member, the toner on the photosensitive member receives an insufficient stirring effect, so that a good image quality cannot be expected. Further, in the case of developing an image requiring a large amount of toner over a wide area, such as a solid black image, the toner supply onto the electrostatic latent image is liable to be insufficient, thus resulting in a lower image density. At a higher circumferential speed ratio, the amount of the toner supply to the developing site is increased and the frequency of toner attachment to and separation from the latent image is increased to enhance the repetition of recovery from an unnecessary part and attachment onto a necessary part, thus providing an image faithful to the latent image. However, if the circumferential speed ratio exceeds 3.0, various problems (such as an image density lowering due to an excessive charge of the toner) are caused by excessive charging of the toner, and toner deterioration and the toner sticking onto the toner-carrying member due to mechanical stress are caused and promoted.

Next, a step of charging the photosensitive member will be described.

In the present invention, while a non-contact charging step as by using a corona charger can be adopted, it is preferred to adopt a contact charging scheme wherein a charging member is abutted to the photosensitive member for charging the photosensitive member. In this instance, a charging roller may preferably be used as a contact charging member.

The charging roller may preferably be operated under at a roller abutting pressure of 4.9–490 N/m (5–500 g/cm) under application of a DC voltage or a DC voltage superposed with an AC voltage. In the case of DC/AC superposed voltage, it is preferred that the AC voltage=0.5–5 kVpp, AC frequency=50 Hz to 5 kHz and DC voltage=±0.2 to ±5 kV.

As another contact charging means, it is possible to use a charging blade or a charging brush. By using such contact charging means, the charging voltage can be substantially lowered, and the ozone generation can be suppressed.

The charging roller and the charging blade as the contact charging means may preferably comprise electroconductive rubber and can be surface-coated with a releasable film. The releasable film may comprise, e.g., nylon-based resin, PVdF (polyvinylidene fluoride), PVdC (polyvinylidene chloride) or fluorine-containing acrylic resin.

Next, a transfer step will be described.

In the present invention, while a non-contact transfer step as by using a corona charger can be adopted it is preferred to adopt a contact transfer scheme wherein a transfer means is abutted to the photosensitive member via a transfer receiving material.

The transfer means abutted at a linear pressure of at least 2.9 N/m (3 g/cm), more preferably at least 19.6 N/m (20 g/cm). Below 2.9 N/m, difficulties, such as transfer material deviation and transfer failure, are liable to occur.

Figure 5:
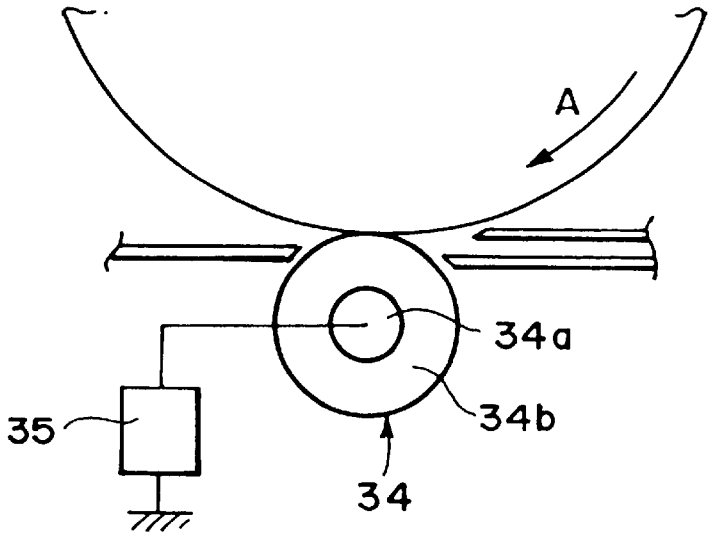
FIG. 5 is a schematic illustration of a contact transfer member.

As the contact transfer means, a transfer roller or a transfer belt may be used. FIG. 5 illustrates a transfer system using a transfer roller. Referring to FIG. 5, the system includes a transfer roller 34, which comprises at least a core metal 34*a* and an electroconductive elastic layer 34*b*. The electroconductive elastic layer 34*b* may comprise an elastic material, such as urethane rubber or EPDM, of which the volume resistivity is adjusted to ca. $10^6$–$10^{10}$ ohm.cm by dispersion therein of a conductivity-imparting material, such as carbon. The transfer roller 34 is supplied with a transfer bias voltage from a transfer bias voltage supply 35.

Next, a photosensitive member usable in the present invention will be described.

The photosensitive member may suitably comprise a photosensitive drum or a photosensitive drum having a layer of photoconductive insulating material, such as a-Si, CdS, $ZnO_2$, OPC (organic photoconductor) or a-Si (amorphous silicon).

In the present invention, it is particularly preferred to use a photosensitive member having a surface layer principally comprising a polymeric binder. Examples thereof may include: an inorganic photoconductor, such as selenium or a-Si coated with a protective film (protective layer) principally comprising a resin; and a function-separation type organic photoconductor having a charge transport layer comprising a charge-transporting material and a resin as a surface layer, optionally further coated with a resinous protective layer. In these cases, the surface layer (or protective layer) may preferably be provided with a releasability, which is imparted by, e.g., (i) using a layer-forming resin having a low surface energy, (ii) adding an additive imparting water-repellency or lipophilicity, or (iii) dispersing powder of a material exhibiting a high reliability.

For (i), a functional group, such as a fluorine-containing group or a silicone-containing group may be introduced into the resin constituting unit. For (ii), e.g., a surfactant may be added as such an additive imparting water-repellency or lipophilicity. For (iii), the material exhibiting a higher releasability may include: fluorine-containing compounds, such as polytetrafluoroethylene, polyvinylidene fluoride and fluorinated carbon.

By adopting a means as described above, the photosensitive member may be provided with a surface exhibiting a contact angle with water of at least 85 deg., thereby further improving its durability and toner transferability. It is further preferred that the photosensitive member surface exhibits a contact angle with water of 90 deg. or higher. In the present invention, among the above-mentioned means (i)–(iii), the means (iii) of dispersing releasable powder of a fluorine-containing resin into the surface most layer is preferred, and it is particularly preferred to use release powder of polytetrafluoroethylene.

The inclusion of such release powder into the surface layer may be accomplished by forming a layer of binder resin containing such release powder dispersed therein as a surfacemost layer, or incorporating such release powder in an already contemplated surface layer in the case of an organic photosensitive member already having a resinous surface layer. The release powder may preferably be added in such an amount as to occupy 1–60 wt. %, more preferably 2–50 wt. %, of the resultant surface layer. Below 1 wt. %, the effects of improving toner transferability and durability may be insufficient. Above 60 wt. %, the surface or protective layer may have a lower strength or cause a remarkable lowering in effective light quantity incident to the photosensitive member.

As mentioned above, it is preferred to adopt a contact charging scheme wherein a charging member is abutted against the photosensitive member, but this exerts a larger load onto the photosensitive member surface than in the corona discharge charging method. Accordingly, the provision of a surface protective layer on the photosensitive member can exhibit a remarkable improvement in durability and is a preferred mode of application.

The provision of a surface protective layer is particularly effectively applicable also to a preferred embodiment of the image forming method according to the present invention including a contact charging scheme and a contact transfer scheme applied to a photosensitive member having a small diameter of at most 50 mm. More specifically, in the case of using such a photosensitive member having a smaller diameter, an equal abutting pressure in terms of a linear pressure can exert a larger local pressure caused by stress concentration due to a larger degree of curvature (i.e., a smaller radius of curvature). The same phenomenon occurs in a belt-form photosensitive member having a radius of curvature of at most 25 mm where a contact charging or transfer member is abutted.

Figure 8:
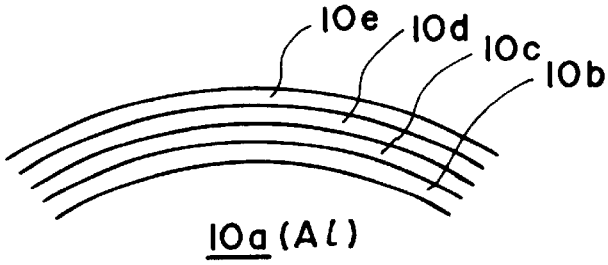
FIG. 8 is a schematic partial sectional view of a photosensitive member showing its layer structure.

According to a preferred embodiment, the photosensitive member may have a function-separation type OPC photosensitive member having a laminar structure as shown in FIG. 8.

Referring to FIG. 8, an electroconductive support 10*a* may generally comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet or film, or an endless belt, optionally further coated with an electroconductive coating layer 10*b*.

Between the electroconductive support 10*a* and a photosensitive layer (10*d* and 10*e*), it is possible to dispose an undercoating layer 10*c* for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethyleneacrylic acid copolymer, polyvinyl butyral, phenolic resin, casein, polyamide, copolymer nylon, glue, gelatin, polyurethane, or aluminum oxide. The thickness may preferably be ca. 0.1–10 $\mu$m, particularly ca. 0.1–3 $\mu$m.

The photosensitive layer may comprise a single layer (not shown) containing both a charge-generation substance and a charge-transporting substance, or a laminated structure (as shown) including a charge generation layer 10*d* containing a charger generation substance, and a charge transport layer 10*e* containing a charge transporting substance, in lamination.

The charge generation layer 10*d* may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–60 wt. %, of the charge generation layer. The charge generation layer may preferably have a thickness of at most 5 $\mu$m, preferably 0.05–2 $\mu$m.

The charge transport layer 10*e* has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may preferably be 5–40 $\mu$m. Examples of the charge transporting substance may include: polycyclic aromatic compounds having in their main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide. Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinyl-anthracene.

The photosensitive layer (10*d* and 10*e*) can be further coated with a protective layer comprising one or more species of a resin, such as polyester, polycarbonate, acrylic resin, epoxy resin, or phenolic resin together with its hardening agent, as desired.

Such a protective layer may further contain electroconductive fine particles of metal or metal oxide, preferred examples of which may include ultrafine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in mixture of two or more species. The electroconductive particles dispersed in the protective layer may preferably have a particle size smaller than the wavelength of light incident thereto so as to prevent scattering of the incident light due to the dispersed particles. More specifically, the electroconductive particles dispersed in the present invention may preferably have a particle size of at most 0.5 $\mu$m. The content thereof may preferably be 2–90 wt. %, further preferably 5–80 wt. %, of the total solid matter in the protective layer. The protective layer may preferably have a thickness of 0.1–10 $\mu$m, more preferably 1–7 $\mu$m.

The above-mentioned layers may be formed, e.g., by spray coating, beam coating or dip coating.

Next, an embodiment of the image forming method according to the present invention including a non-contact developing scheme will be described with reference to FIGS. 1 and 2.

Referring to FIG. 1, an image forming apparatus as shown includes a photosensitive drum (photosensitive member) 100, around which are disposed a primary charger roller 117, a developing device 140, a transfer charger roller 114, a cleaner 116, registration rollers 124, etc. The photosensitive member 100 is charged to, e.g., −700 volts by the primary charger roller 117 receiving an AC voltage of 2.0 kVpp superposed with a DC voltage of −700 volts, and then exposed to laser light 123 emitted from a laser illumination system 121 to form an electrostatic image thereon. The electrostatic latent image on the photosensitive member 100 is developed with a mono-component-type magnetic toner to form a toner image, which is then transferred onto a transfer (-receiving) material P by the action of a transfer roller 114 abutted against the photosensitive member 100 via the transfer material P. The transfer material carrying the toner image is conveyed by a conveyer belt 125, etc., to reach a fixing device 126, where the toner image is fixed onto the transfer sheet P under application of heat and pressure. A portion of the toner remaining on the photosensitive member 100 is cleaned by and recovered into a cleaning means 116, and the cleaned photosensitive member 100 is then further subjected to a subsequent image forming cycle starting with the primary charging by the primary charger roller 117.

As shown in FIG. 2, the developing device 140 includes a cylindrical toner-carrying member 102 (hereinafter sometimes called a "developing sleeve") formed of a non-magnetic metal, such as aluminum or stainless steel, in a position opposite to and close to the photosensitive member 100, so as to leave a gap of, e.g., ca. 300 $\mu$m between the photosensitive member 100 and the developing sleeve 102 by a sleeve/photo-sensitive member gap retention member (not shown), etc. Within the developing sleeve 102, a magnet roller 104 is disposed fixedly and concentrically with the developing sleeve 102, while allowing the rotation of the developing sleeve 102. As shown in FIG. 2, the magnet roller 104 is provided with a plurality of magnetic poles including S1 for development, N1 for regulating toner coating amount, S2 for taking in and conveying the toner and N2 for preventing the blowing out of the toner. The toner in the toner vessel of the developing device 140 is applied by a toner application roller 141 therein onto the developing sleeve 102 and supplied to a developing region facing the photosensitive member 100 under a controlled supply rate by an elastic toner coating regulation blade 103 abutted at a controlled pressure against the developing sleeve 102. At the developing region, a DC/AC-superposed bias voltage is applied between the photosensitive member 100 and the developing sleeve 102 from a bias voltage supply 15, whereby the magnetic toner on the developing sleeve 102 is caused to jump onto the photosensitive member 100 depending on a latent image thereon to form a visible toner image thereon.

Then, another embodiment of the image forming method according to the present invention including a contact developing scheme and a cleanerless sheme will be described with reference to FIGS. 3 and 4.

Referring to FIG. 3, an image forming apparatus as shown includes a photosensitive member 1, a developing device 40, a transfer (-receiving) material 27, such as paper, a transfer member 14, a fixing device including a pressure roller 26 and a heating roller 28, and a primary charging member 17 directly contacting the photosensitive member 1 to charge the photosensitive member 1. The primary charging member 17 is connected to a voltage supply 31 for applying a voltage thereto to uniformly charge the photosensitive member 1. The developing device 40 contains a toner 42, and includes a toner-carrying member 4 rotating in an indicated arrow direction in contact with the photosensitive member 1. The developing device 40 further includes a developing blade 43 for regulating an amount of toner to be supplied and charging the toner, and an application roller 41 rotating in an indicated arrow direction for applying the toner 42 onto the toner-carrying member 4 and triboelectrically charging the toner 42 through friction with the toner-carrying member 4. The toner-carrying member 4 is connected to a developing bias voltage supple 33 so as to receive a developing bias voltage. The application roller 41 is also connected with a voltage supply 32 so as to receive a voltage which is set to be relatively negative in the case of a negatively chargeable toner or relatively positive in the case of a positively chargeable toner, respectively with respect to the developing bias voltage supplied to the toner-carrying member 4.

The transfer member 14 is connected to a transfer voltage supply 34 for supplying a transfer bias voltage which has a polarity opposite to the charge polarity on the photosensitive member 1.

Herein, the photosensitive member 1 and the toner-carrying member 4 are preferably designed to contact in a width (length in rotatively moving direction, so-called developing nip width) of 0.2–8.0 mm. Below 0.2 mm, the developing toner supply is liable to be insufficient, thus failing to provide a sufficient image density, and also the transfer residual toner recovery becomes insufficient. Above 8.0 mm, the toner supply is liable to be excessive to result in severe fog, and the wearing of the photosensitive member is adversely affected.

The toner-carrying member 4 may preferably be an elastic roller having a surface elastic layer **4*b***. The elastic layer may suitably have a hardness (JIS A) of 20–65 deg.

The toner-carrying member 4 may preferably have a volume resistivity in a range of $10^2$–$10^9$ ohm.cm. Below $10^2$ ohm.cm, an eddy current is liable to occur in case where a pinhole is present on the surface of the photosensitive member 1. On the other hand, above $10^9$ ohm.cm, the toner is liable to be excessively charged triboelectrically, thus being liable to cause an image density lowering.

The toner 42 may preferably be applied at a rate of 0.1–2.0 mg/cm$^2$ on the toner-carrying member 4. Below 0.1 mg/cm$^2$, it is difficult to obtain a sufficient image density. Above 2.0 mg/cm$^2$, it becomes difficult to uniformly charge all the toner particles by triboelectrification, thus causing inferior fog. A range of 0.2–1.2 mg/cm$^2$ is further preferred.

The toner coating amount is regulated by the developing blade 43, and the developing blade 43 contacts the toner-carrying member 4 via a toner layer thereon. The contact pressure may preferably be in the range of 5–50 g/cm. Below 5 g/cm, the control of toner coating amount as well as the uniform triboelectrification becomes difficult, thus causing fog. On the other hand, above 50 g/cm, the toner particles receive an excessive load, the particles are liable to be deformed, and the toner sticking onto the developing blade 43 and the toner-carrying member 4 are liable to occur.

For the toner coating amount control, a metal blade or roller can also be used instead of such an elastic blade for applying the toner under a pressure.

The elastic material may preferably comprise a material having an appropriate chargeability position in a triboelectric chargeability series so as to charge the toner to an appropriate polarity and may for example comprise: an elastomer, such as silicone rubber, urethane rubber or NBR; an elastic synthetic resin, such as polyethylene terephthalate; an elastic metal, such as stainless steel, steel and phosphor bronze; or a composite material of these.

In the case of providing a durable elastic member, it is preferred to use a laminate of an elastic metal and a resin or rubber or use a coated member.

Further, the elastic material can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

Referring again to FIG. 3, the photosensitive member 1 rotating in the indicated arrow direction is uniformly charged by the primary charging member 17 also rotating in the indicated arrow direction in contact with the photosensitive member 1.

The primary charging member 17 used herein is a charging roller basically comprising a core metal 17*b* and an electroconductive elastic layer 17*a* surrounding a periphery of the core metal 17*b*. The charging roller 17 is pressed against the photosensitive member 1 at a pressing force and rotated mating with the rotation of the photosensitive member 1.

The charging step using the charging roller 17 may preferably be performed while abutting the roller 17 at a pressure of 5–500 g/cm. The voltage applied to the roller 17 may be a DC voltage alone or a DC/AC-superposed voltage, without any particular restriction. In the present invention, it is suitable to apply a DC voltage alone to the charging roller. In this case, a voltage in a range of ±0.2 to ±5 kV is suitably used.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

Following the primary charging step, the uniformly charged photosensitive member 1 is exposed to image data-carrying light 23 from a light emission device 21 to form an electrostatic latent image on the photosensitive member 1, which is then developed with the toner carried on the toner-carrying member 4 at a position abutted to the toner-carrying member 4 to form a visible toner image on the photosensitive member 1. In a preferred embodiment, the electrostatic latent image is formed as a digital latent image comprising dot images on the photosensitive member 1. By adopting the developing method of the present invention, the dot images can be developed faithfully without being disturbed. Then, the toner image on the photosensitive member 1 is transferred onto a transfer (-receiving) material 27 by means of a transfer member 14 basically comprising a core metal 14*a* and an electroconductive elastic layer 14*b* surrounding the core metal 14*a*, an the transfer material 27 carrying the toner image 29 is then conveyed by a conveyer belt 25 to a fixing device comprising a pressure roller 26 and a heating roller 28, where the toner image 29 is fixed onto the transfer material 27 to provide a permanent image. Incidentally, in addition to such a hot-roller fixing device as shown in FIG. 3 comprising a heating roller 28 having therein a heat-generating member such as a halogen heater and an elastic pressure roller 26 pressed against the heating roller 28, it is also possible to use a heat fixation scheme wherein a transfer material carrying a toner image is heated for fixation via a film.

On the other hand, a portion of the toner (transfer residual toner) remaining on the photosensitive member 1 after the transfer step is passed by the primary charging member 17 to again reach the developing nip, where the transfer residual toner is recovered into the developing device 40 by the toner-carrying member 4.

Various spherical property data characterizing the present invention are based on values measured according to the following methods.

(1) A Ratio (B/A) Between an Iron Content (B) and a Carbon Content (A) at Surfaces of Toner Particles If a sample toner contains external additives, the sample toner is washed to remove the external additives with a solvent such as isopropanol, not dissolving the toner, and the remaining toner particles are subjected to a surface composition analysis by ESCA (X-ray photoelectron spectroscopy, by using an apparatus and conditions as follows:

Apparatus:

X-ray Photoelectron Spectroscope Model 160S, available from Physical Electronics Industries, Inc. ("PHI").

Conditions:

X-ray source: MgKα (400 W)

Spectral region: an illumination spot area of 800 μm in diameter.

From measured peak intensities for the respective elements, the concentrations (atom %) of Fe (B) and C (A) are determined based on relative sensitivity factors provided by PHI Inc., and a ratio (B/A) therebetween is determined.

(2) Average Circularity ($\phi_{av}$) of Toner Particles

A sample toner containing external additives may be directly subjected a measurement by a flow-type particle image analyzer ("FPIA-1000", available from Toa Iyou Denshi K.K.) since the determination is based on particles having a circle-equivalent diameter of at least 3 μm).

For a measurement, ca. 5 mg of a sample toner is dispersed in 10 ml of water in which ca. 0.1 mg of a nonionic surfactant has been dissolved. The resultant mixture is subjected to dispersion with ultrasonic waves (20 kHz, 50 W) for 5 min. to obtain a dispersion liquid containing 5000–20000 particles/μl, and the dispersion liquid is subjected to measurement of a circularity distribution with respect to particles having a circle-equivalent diameter (C.E.D.) of at least 3 μm by means of the above-mentioned flow-type particle image analyzer.

The details of the measurement is described in a technical brochure and an attached operation manual on "FPIA-1000" published from Toa Iyou Denshi K.K. (Jun. 25, 1995) and JP-A 8-136439. The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two dimensional image having a certain area parallel to the flow cell. From the two-dimensional image area of each particle, a diameter of a circle having an identical area (an equivalent circle) is determined as a circle-equivalent diameter. Further, for each particle, a peripheral length ($L_0$) of the equivalent circle is determined and divided by a peripheral length ($L_1$) measured on the two-dimensional image of the particle to determine a circularity ø of the particle, i.e., $$\phi = L_0/L.$$

From the distribution of circularities ($\phi_i$) of individual particles, an average circularity ($\phi_{av}$) is determined as follows:

$$\phi_{av} = \sum_{i=1}^{m} (\phi_i / m)$$

For convenience of calculation, an actual calculation may be automatically performed according to the following scheme: That is, circularities ($\phi_i$) of individual particles are classified into 61 divisions by an increment of 0.010 within a circularity range of 0.400–1.000, i.e., 0.400–below 0.410, 0.410–below 0.420, . . . 0.990–below 1.000, and 1.000. Then, an average circulaty øav is determined based on central values and frequencies of the respective divisions.

As is understood from the above definition formula of ($\phi = L_0/L$), a circularity ø is an index showing a degree of unevenness of a particle, and a perfectly spherical particle gives a value of 1.000 and a particle having a more complicated shape gives a smaller value of circularity.

(3) Toner Particle Size Distribution

Coulter Counter TA-II (available from Coulter Electronics, Inc.) is used as a measurement apparatus together with an interface for outputting a number-basis distribution and a volume-basis distribution (available from Nikkaki K.K.) and a personal computer ("CX-1", available from Canon K.K.) connected thereto, and an electrolytic solution comprising ca. 1% NaCl aqueous solution which may be prepared by dissolving a reagent-grade sodium chloride or commercially available as "ISOTON-II" (from Coulter Scientific Japan). For measurement, into 100 to 150 ml of the electrolytic solution, 0.1 to 5 ml of a surfactant (preferably an alkylbenzenesulfonic acid salt) is added as a dispersant, and 2–20 mg of a measurement sample is added. The resultant dispersion of the sample in the electrolytic solution is subjected to a dispersion treatment by an ultrasonic disperser for ca. 1–3 min., and then subjected to measurement of particle size distribution by using the above-mentioned Coulter Counter TA-II equipped with a 100 μm-aperture to obtain number-basis and volume-basis particle size distributions of particles of 2–40 μm. From the volume-distribution, a weight-average particle size (D4) and a number-average particle size (D1) may be calculated by using a central value and a frequency of each channel.

Substantially identical measured values are obtained when toner particles alone are subjected to the measurement and when a toner containing an external additive in addition to the toner particles is subjected to the measurement since the weight and the number of the external additive having particle sizes of 2 μm or larger are very small compared with those of the toner particles.

EXAMPLES

Hereinbelow, the present invention will be described more specifically based on Examples. Incidentally, "part(s)" and "%" used hereinafter for describing compositions or formulations are based on weight unless otherwise noted specifically.

Production Example 1 for Hydrophobic Iron Oxide

Into an aqueous solution of ferrous sulfate, an aqueous caustic solution in an amount of 1.0–1.1 equivalent to the iron ions in the ferrous sulfate solution was added to form an aqueous solution containing ferrous hydroxide.

While the aqueous solution was maintained at pH 9, air was blown thereinto to cause the oxidation reaction at 80–90° C., thereby forming a slurry liquid containing seed crystals.

Then, to the slurry liquid, a ferrous sulfate aqueous solution in an amount of 0.9–1.2 equivalent to the initial alkali amount (sodium component in the caustic soda) was added, and then while keeping the slurry at pH 8, air was blown thereinto to proceed with oxidation. At the final stage of oxidation, the liquid pH was adjusted to ca. 6, and 0.5% (based on the resultant magnetic iron oxide) of a silane coupling agent ($n\text{-}C_4H_9Si(OCH_3)_3$) was added to the slurry liquid product, followed by sufficient stirring. The resultant hydrophobized iron oxide particles were washed, filtered out, dried and slightly disintegrated to obtain Hydrophobic iron oxide 1, of which the properties are shown in Table 1 together with iron oxide particles produced in the following Production Examples.

Production Example 2 for Hydrophobic Iron Oxide

Oxidation was performed in the same manner as in Example 1. After the oxidation, the product iron oxide particles were taken out of the reaction system, by filtration and washing with water, and then re-dispersed into water without intermediate drying. Then, the liquid pH of the dispersion liquid was adjusted to ca. 6, and under sufficient stirring, 0.5% of silane coupling agent ($n\text{-}C_6H_{13}Si(OH_3)_3$) was added to effect a coupling treatment. The resultant hydrophobized iron oxide particles were washed, filtered out, dried and slightly disintegrated to obtain Hydrophobic iron oxide 2.

Production Example 3 for Hydrophobic Iron Oxide

Hydrophobic iron oxide 3 was prepared in the same manner as in Production Example 2 except for using $n\text{-}C_{10}H_{21}Si(OCH_3)_3$ as a silane coupling agent.

Production Example 4 for Hydrophobic Iron Oxide

Hydrophobic iron oxide 4 was prepared in the same manner as in Production Example 2 except for using γ-glycidyltrimethoxysilane as a silane coupling agent.

Production Example 5 for Hydrophobic Iron Oxide

Into an aqueous solution of ferrous sulfate, an aqueous caustic solution in an amount of 1.0–1.1 equivalent to the iron ions in the ferrous sulfate solution was added to form an aqueous solution containing ferrous hydroxide.

While the aqueous solution was maintained at pH 9, air was blown thereinto to cause the oxidation reaction at 80–90° C., thereby forming a slurry liquid containing seed crystals.

Then, to the slurry liquid, a ferrous sulfate aqueous solution in an amount of 0.9–1.2 equivalent to the initial alkali amount (sodium component in the caustic soda) was added, an then while keeping the slurry at pH 8, air was blown thereinto to provide with oxidation. At the final stage of oxidation, the liquid pH was adjusted to ca. 6, to complete the oxidation. Then, the resultant iron oxide particles were washed, filtered out, dried, and finally the agglomerated particles were disintegrated to obtain Iron oxide particles a. The thus-obtained Iron oxide particles a were then subjected to hydrophobization with 0.5% of a silane coupling agent ($n\text{-}C_6H_{13}Si(OCH_3)_3$) diluted with 5 times in weight of methanol in a gaseous phase to obtain Hydrophobic iron oxide 5.

Production Example 6 for Hydrophobic Iron Oxide

Iron oxide particles a obtained in Production Example 5 were dispersed in water, and after the liquid pH was adjusted to ca. 6, 0.5% of silane coupling agent ($n\text{-}C_6H_{13}Si(OCH_3)_3$) was added under a sufficient stirring. The resultant hydrophobized iron oxide particles were washed, filtered out, dried and slightly disintegrated to obtain Hydrophobic iron oxide 6.

The particle size data for the above-prepared Hydrophobic iron oxides, 1–6 are summarized in Table 1 below.

TABLE 1

| Hydrophobic iron oxide | DV* (μm) | Distribution 0.03–0.1 μm (% by number) | Distribution ≧0.3 μm (% by number) |
|---|---|---|---|
| 1 | 0.19 | 20 | 2 |
| 2 | 0.19 | 19 | 2 |
| 3 | 0.19 | 22 | 3 |
| 4 | 0.21 | 41 | 4 |
| 5 | 0.29 | 9 | 11 |
| 6 | 0.28 | 13 | 9 |

*Dv = volume-average particle size.

The thus-obtained hydrophobic iron oxides were used and evaluated in following Examples and Comparative Examples.

Example 1

Into 709 parts of deionized water, 451 parts of 0.1 mol/l-$Na_3PO_4$ aqueous solution was added, and the mixture was heated to 60° C., followed by gradual addition of 67.7 parts of 1.0 mol/l-$CaCl_2$ aqueous solution to form an aqueous medium containing $Ca_3(PO_4)_2$.

Separately, the following ingredients:

| | |
|---|---|
| Styrene | 82 parts |
| n-butyl acrylate | 18 parts |
| Polyester resin | 5 parts |
| Negative charge control agent (monoazo dye Fe compound) | 2 parts |
| Hydrophobic iron oxide 1 | 100 parts |

were uniformly dispersed and mixed by an attritor ("ATTRITOR", available from Mitsui Miike Kakoki K.K.) to form a monomer composition.

Into the above monomer composition warmed at 60° C., 20 parts of ester wax (m.p. (melting point)=70° C.) was mixed and dissolved, and polymerization initiators including 8 parts of 2,2'-azobis(2,4-dimethylvaleronitrile) ($t_{1/2}$ (halflife) at 60° C.=140 min.) and 2 parts of dimethyl-2,2'-azobisisobutyrate ($t_{1/2}$ (at 60° C.)=270 min., $t_{1/2}$ (at 80° C.)=80 min.) were added to form a polymerizable monomer composition.

Into the above-prepared aqueous medium, the polymerizable monomer composition was charged, and the system was stirred at 10,000 rpm for 15 min. by means of a homomixer ("TK-HOMOMIXER" available from Tokushu Kika Kogyo K.K.) at 60° C. in an $N_2$ environment to form particles (or droplets) of the polymerizable monomer composition. Thereafter, the system was stirred by paddle-stirring blades and subjected to 1 hour of reaction at 60° C., followed further by stirring for 10 hours at 80° C. After the reaction, the suspension liquid was cooled, and hydrochloric acid was added thereto to dissolve $Ca_3(PO_4)_2$. Then, the polymerizate was filtered out, washed with water and dried to obtain toner particles.

Then, 100 parts of the toner particles were blended with 1.4 parts of hydrophobic colloidal silica (having $S_{BET}$ (BET specific surface area)=120 $m^2/g$ after hydrophobization) formed by successive hydrophobization treatment with hexamethyldisilazane and then with silicone oil, by means of a Henschel mixer (available from Mitsui Miike Kakoki K.K.) to obtain Toner A having a weight-average particle size (D4) of 6.2 μm.

Toner A was subjected to an observation of state of dispersion of Hydrophobic iron oxide 1 in toner particles on photographs of flakes of toner particles through a TEM as described before for determination of D/C ratios. More specifically, on the TEM photographs of toner particles, toner particles having provided sectional views giving a circle-equivalent diameter falling within a range of ±10% of the number-average particle size (D1) of the sample toner particles are selected for further analysis. On a toner particle sectional view, a concentric similar figure having a half diameter (area of one fourth) is depicted. Further, the numbers of iron oxide particles of at least 0.03 μm counted in the toner particle sectional view (including the similar figure) and in the similar figure (of one fourth area) are counted and denoted by $n_t$ and $n_c$, respectively. A ratio of $n_c/n_t$ closer to ¼ represents a more uniform distribution of iron oxide particles in the toner particle, and a $n_c/n_t$ ratio in a range of ⅜–⅕ may be regarded as an indication of a good dispersion state. As a result of the observation, Toner A provided a $n_c/n_t$ value thus obtained of substantially ¼, thus exhibiting a very uniform distribution of iron oxide particles in the toner particles.

Example 2

Magnetic toner particles were obtained in the same manner as in Example 1 except for using 100 parts of Hydrophobic iron oxide 2 instead of Hydrophobic iron oxide 1 and a different stirring speed for particle formation. Then, 100 parts of the toner particles were blended with 1.7 parts of hydrophobic colloidal silica in the same manner as in Example 1 to obtain Toner B (D4=4.9 μm).

Example 3

Magnetic toner particles were obtained in a similar manner as in Example 1 except for using 150 parts of Hydrophobic iron oxide 3 instead of Hydrophobic iron oxide 1. Then, 100 parts of the toner particles were blended with 0.7 part of hydrophobic colloidal silica in the same manner as in Example 1 to obtain Toner C (D4=9.7 μm).

Example 4

Magnetic toner particles were obtained in a similar manner as in Example 1 except for using 190 parts of Hydrophobic iron oxide 4 instead of Hydrophobic iron oxide 1. Then, 100 parts of the toner particles were blended with 2.0 parts of hydrophobic colloidal silica in the same manner as in Example 1 to obtain Toner D (D4=3.5 μm).

Examples 5 and 6

Two types of toner particles were prepared in similar manners as in Example 3 except for changing the amounts of Hydrophobic iron oxide 3 to 5 and 200 parts, respectively, and changing the amounts of $Na_3PO_4$ aqueous solution and $CaCl_2$ aqueous solution. Then, 100 parts of the respective toner particles were blended with 1.0 part and 3.0 parts, respectively, of hydrophobic colloidal silica to obtain Toner E (D4=10.5 μm) and Toner F (D4=1.9 μm), respectively.

Comparative Example 1

Into 709 parts of deionized water, 451 parts of 0.1 mol/l-$Na_3PO_4$ aqueous solution was added, and the mixture was heated to 60° C., followed by gradual addition of 67.7 parts of 1.0 mol/l-$CaCl_2$ aqueous solution to form an aqueous medium containing $Ca_3(PO_4)_2$.

Separately, the following ingredients:

| | |
|---|---|
| Styrene | 82 parts |
| n-butyl acrylate | 18 parts |
| Polyester resin | 5 parts |
| Hydrophobic iron oxide 1 | 100 parts |

were uniformly dispersed and mixed by an attritor ("ATTRITOR", available from Mitsui Miike Kakoki K.K.) to form a monomer composition.

Into the above monomer composition warmed at 60° C., and polymerization initiators including 8 parts of 2,2'-azobis (2,4-dimethylvaleronitrile) ($t_{1/2}$ (halflife) at 60° C.=140 mm.) and 2 parts of dimethyl-2,2'-azobisisobutyrate ($t_{1/2}$ (at 60° C.)=270 min., $t_{1/2}$ (at 80° C.)=80 min.) were added to form a polymerizable monomer composition.

Into the above-prepared aqueous medium, the polymerizable monomer composition was charged, and the system was stirred at 10,000 rpm for 15 min. by means of a homomixer ("TK-HOMOMIXER" available from Tokushu Kika Kogyu K.K.) at 60° C. in an $N_2$ environment to form particles (or droplets) of the polymerizable monomer composition. Thereafter, the system was stirred by paddle-stirring blades and subjected to 1 hour of reaction at 60° C., followed further by stirring for 10 hours at 80° C. After the reaction, the suspension liquid was cooled, and hydrochloric acid was added thereto to dissolve $Ca_3(PO_4)_2$. Then, the polymerizate was filtered out, washed with water and dried to obtain iron oxide-containing resin powder (D4=10.0 μm).

Then, 205 parts of the iron oxide-containing resin powder was blended with 0.8 part of a negative charge control agent (monoazo dye Fe compound) and 3 parts of ethylene-propylene copolymer (Mw (weight-average molecular weight)=6000), and the blend was melt-kneaded through a twin-screw extruder. After cooling, the melt-kneaded product was coarsely crushed by a hammer mill and finely pulverized by a jet mill to obtain toner particles a. Then, 100 parts of the toner particles a were blended with 1.2 parts of the same by hydrophobic colloidal silica in a Henschel mixer to obtain Toner G (D4=7.4 μm).

Comparative Example 2

Toner particles a prepared in Comparative Example 1 were surface-treated by application of a mechanical impact to obtain Toner particles b, 100 parts of which were blended with 1.2 parts of the same hydrophobic colloidal silica as used in Example 1 in a Henschel mixer to obtain Toner H.

Comparative Example 3

Toner particles were obtained in the same manner as in Example 1 except for using 100 parts of Hydrophobic iron oxide 5 instead of Hydrophobic iron oxide 1. Then, 100 parts of the toner particles were blended with 1.2 parts of hydrophobic colloidal silica similarly as in Example 1 to obtain Toner I (D4=6.9 μm).

This toner I was subjected to evaluation of dispersion state of iron oxide particles in toner particles by TEM observation in the same manner as in Example 1, whereby Toner I provided a ratio $n_c/n_t$ of ca. 1/6, thus indicating ununiform distribution of iron oxide particles within toner particles and particularly predominant presence at the surface region. This is because the iron oxide particles were ununiformly hydrophobized, and iron oxide particles of low hydrophobicity were rather localized at the toner particle surfaces.

Comparative Example 4

Toner particles were obtained in the same manner as in Example 1 except for using 150 parts of Hydrophobic iron oxide 6 instead of Hydrophobic iron oxide 1. Then, 100 parts of the toner particles were blended with 1.7 parts of hydrophobic colloidal silica similarly as in Example 1 to obtain Toner J (D4=4.8 μm).

The properties of Toners A–J prepared in the above Examples and Comparative Examples are shown in Table 2 appearing hereinafter.

Each toner was evaluated by image formation by using a commercially available laser beam printer ("LBP-SX", made by Canon K.K.) adopting a non-contact developing scheme after remodeling of using a urethane rubber-made elastic rubber blade, a toner application roller and a cleaning magnet roller, and omitting a magnet installed inside the toner-carrying member (developing sleeve) in the process cartridge unit.

Figure 6:
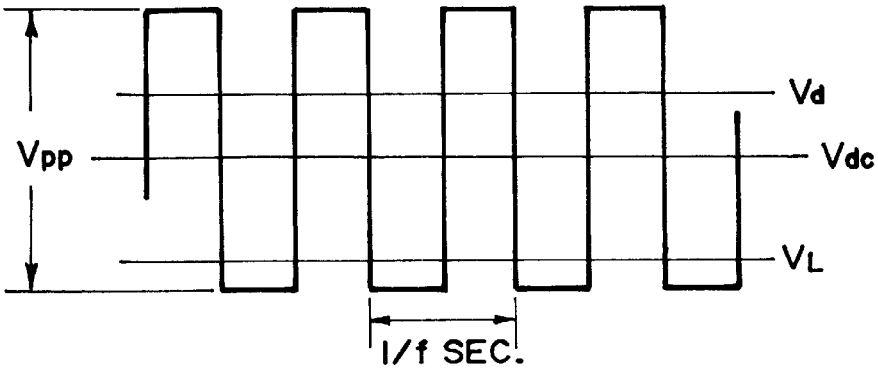
FIG. 6 is a waveform diagram showing an example of developing bias voltage waveform.

For the image formation, an alternating bias electric field having a waveform a shown in FIG. 6 was applied between the developing sleeve and the photosensitive drum. More specifically, the photosensitive drum was first charged to a dark-part potential Vd of −600 volts and exposed to provide a light-part potential $V_L$ of −150 volts. Further, an alternating bias voltage comprising an AC voltage of 1800 Vpp at a frequency f of 3200 Hz superposed with a DC bias voltage Vdc of −400 volts was applied across a gap of 300 μm between the photosensitive drum and the developing sleeve, which was rotated at a peripheral speed of 200% of the photosensitive drum.

Continuous image formation on 5000 sheets was performed in a normal temperature/normal humidity environment (NT/NH=23° C./65% RH). As a result, Toner A (Example 1) provided good images free from scattering even after printing on 5000 sheets. After the continuous image formation, the toner on the developing sleeve was removed by air, whereby no toner sticking at all was observed as a result of eye observation.

Identical continuous image forming tests were performed also in a high temperature/high humidity environment (HT/HH=32.5° C./85%RH) and a low temperature/low humidity environment (LT/LH=10° C./15%RH).

The image forming performances were evaluated with respect to image density (I.D.), fog, dot reproducibility (dot) and transfer efficiency (Teff) according to the following method, and the results are inclusively shown in Table 3 appearing hereinafter.

(a) Image Density (I.D.)

Measured by using a Macbeth densitometer ("RD918", available from Macbeth Co.) at an initial stage (on a 100th sheet) and at a final stage.

(b) Fog

Fog was measured at an initial stage (on a 100th sheet) and at a final stage by using a reflective densitometer ("REFLECTOMETER MODEL TC-6DS", available from Tokyo Denshoku K.K.) by using a green filter, and a fog value was calculated according to the following formula:

$$Fox\ (\%)=(\text{reflectance of white paper before use } (\%))-(\text{reflectance of non-image portion of the white paper after printing } (\%))$$

A fog value of 2.0% or below may be regarded as a good image.

(c) Dot Reproducibility (Dot)

Figure 7:
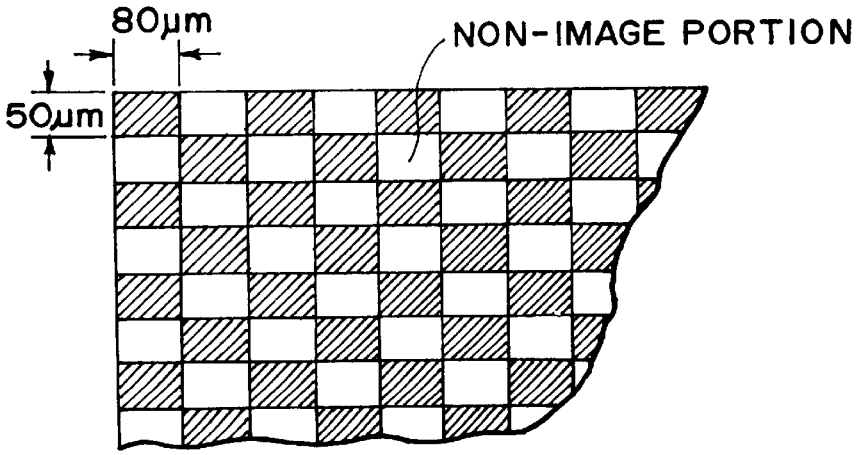
FIG. 7 illustrates a checker pattern for evaluating a toner developing performance.

Image formation was performed for reproduction of a checker pattern having a unit size of 80 μm×50 μm as shown in FIG. 7, and the number of lacked black dots among 100 dots was counted by observation through a microscope and evaluated according to the following standard.

A: at most 2 dots

B: 3–5 dots

C: 6–10 dots

D: 11 dots or more (d) Transfer Efficiency (T.E.)

At an initial stage (at the time of forming images on 100 sheets), transfer residual toner on the photosensitive member after transfer of a solid black image is taken on a polyester adhesive tape (by application and peeling therefrom) and the adhesive tape carrying the transfer residual toner is then applied on white paper to measure a Macbeth (reflective) density C. An identical polyester adhesive tape in a green state is applied on the white paper to measure a Macbeth density D, and the transferred solid black toner image on white paper was covered with an identical polyester adhesive tape to measure a Macbeth density E. A transfer efficiency (T.E.) is calculated according to the following formula:

$$\text{Transfer efficiency } (T.E.)\ (\%)=((E-C)/(E-D))\times 100$$

A transfer efficiency of 90% or higher may be regarded as no problem.

TABLE 2

Toner Properties

| Example | Toner | Hydrophobic iron oxide | D4 (μm) | Iron oxide content (parts) | B/A | Circularity (φ av) | D/C ≦ 0.02 (% by number) |
|---|---|---|---|---|---|---|---|
| 1 | A | 1 | 6.2 | 100 | 0.0002 | 0.990 | 85 |
| 2 | B | 2 | 4.9 | 100 | 0.0002 | 0.991 | 84 |
| 3 | C | 3 | 9.7 | 150 | 0.0001 | 0.980 | 79 |
| 4 | D | 4 | 3.5 | 170 | 0.0006 | 0.978 | 92 |
| 5 | E | 3 | 10.5 | 40 | 0.0001 | 0.981 | 77 |
| 6 | F | 3 | 1.9 | 200 | 0.0004 | 0.971 | 88 |
| Comp.1 | G | 1 | 7.4 | 100 | 0.0004 | 0.895 | 99 |
| Comp.2 | H | 1 | 7.3 | 100 | 0.0003 | 0.964 | 98 |
| Comp.3 | I | 5 | 6.9 | 100 | 0.0012 | 0.972 | 99 |
| Comp.4 | J | 6 | 4.8 | 150 | 0.0012 | 0.985 | 99 |

TABLE 3

Image Forming Performances

| | Fog | | | | Image density | | | | | |
|---|---|---|---|---|---|---|---|---|---|---|
| | NT/NH | | HT/HH | LT/LH | NT/NH | | HT/HH | LT/LH | Dot | T.E.*2(%) |
| Example | Initial *1 | Final | Final | Final | Initial | Final | Final | Final | NT/NH | NT/NH |
| 1 | 0.7 | 0.8 | 0.7 | 0.8 | 1.48 | 1.48 | 1.47 | 1.46 | A | 95 |
| 2 | 0.7 | 0.7 | 0.5 | 0.8 | 1.47 | 1.47 | 1.46 | 1.45 | A | 95 |
| 3 | 0.8 | 0.9 | 0.6 | 0.7 | 1.42 | 1.42 | 1.44 | 1.40 | B | 96 |
| 4 | 0.8 | 1.7 | 1.9 | 0.7 | 1.46 | 1.39 | 1.38 | 1.47 | B | 93 |
| 5 | 1.1 | 1.2 | 1.2 | 1.1 | 1.33 | 1.32 | 1.30 | 1.31 | B | 94 |
| 6 | 1.4 | 1.9 | 1.9 | 1.6 | 1.33 | 1.31 | 1.32 | 1.30 | A | 90 |
| Comp.1 | 1.7 | 1.8 | 1.9 | 1.6 | 1.40 | 1.34 | 1.30 | 1.35 | D | 81 |
| Comp.2 | 1.2 | 1.4 | 1.6 | 1.3 | 1.42 | 1.37 | 1.33 | 1.37 | C | 85 |

TABLE 3-continued

| Image Forming Performances | | | | | | | | | | |
|---|---|---|---|---|---|---|---|---|---|---|
| | Fog | | | | Image density | | | | | |
| | NT/NH | | HT/HH | LT/LH | NT/NH | | HT/HH | LT/LH | Dot | T.E.*2(%) |
| Example | Initial *1 | Final | Final | Final | Initial | Final | Final | Final | NT/NH | NT/NH |
| Comp.3 | 2.0 | 4.9 | 5.1 | 4.4 | 1.38 | 1.30 | 1.28 | 1.32 | B | 88 |
| Comp.4 | 1.4 | 2.0 | 2.2 | 1.2 | 1.43 | 1.34 | 1.30 | 1.41 | C | 89 |

*1: On a 100th sheet.
*2: T.E. = transfer efficiency.

Examples 7–12 and Comparative Examples 5–8

Toners A–J prepared in Examples 1–6 and Comparative Examples 1–4 were evaluated by image formation by using a 600 dpi-laser beam printer ("LBP-860", made by Canon K.K.) after remodeling so as to have an organization as illustrated in FIGS. 3 and 4.

First, the process speed was changed to 60 mm/sec.

The cleaning blade in the process cartridge was removed, and a contact-charging device including an electroconductive rubber roller 17 was introduced so as to receive a DC voltage of −1200 volts.

The developing device in the process cartridge was remodeled by replacing the stainless sleeve (as a toner-carrying member) with a 16 mm-dia. medium resistivity rubber roller of silicone rubber with carbon black dispersed therein (ASKER C hardness of 45 deg., resistivity=$10^5$ ohm/cm), which was abutted against the photosensitive member 1 at a developing nip of ca. 3 mm. The toner-carrying member (rubber roller 4) was rotated so as to move in an identical direction as the photosensitive member 1 at the contact portion and at a peripheral speed of 140% of that of the photosensitive member 1.

The photosensitive member 1 used had an organization as illustrated in FIG. 8 and described as follows. That is, an aluminum (Al) cylinder 10*a* as a substrate having a diameter of 30 mm and a length of 254 mm was successively coated by dipping with the following layers:

(1) an electroconductive coating layer 10*b*: a 15 μm-thick layer principally comprising phenolic resin containing tin oxide and titanium oxide powder dispersed therein;

(2) an undercoating layer 10*c*: a 0.6 μm-thick layer principally comprising modified nylon and copolymer nylon;

(3) a charge generation layer 10*d*: a 0.6 μm-thick layer principally comprising butyral resin containing a titanyl phthalocyanine pigment showing absorptivity in a long wavelength region; and (4) a charge transport layer 10*e*: a 20 μm-thick layer comprising a 8:10 (by weight)-mixture of a hole-transporting triphenylamine compound and polycarbonate resin (having a molecular weight of $2\times10^4$ according to an Ostwald viscometer).

As shown in FIGS. 3 and 4 an application roller 41 comprising foam urethane rubber layer 41*b* on a metal core 41*a* was disposed in a developing vessel 40 as a means for applying a toner 42 onto the toner-carrying member 4. The application roller 41 was supplied with a voltage of ca. −550 volts from a bias voltage application means 32. A resin-coated stainless steel blade 43 was affixed so as to apply a linear contact pressure of ca. 20 g/cm against the toner-carrying member 4 for regulating a toner layer on the toner-carrying member. The toner-carrying member 4 was supplied with a developing bias voltage only of a DC component (−450 volts) from a bias voltage supply 33.

Corresponding to the above remodeling of the process cartridge, the following modifications were adopted.

The photosensitive member 1 was uniformly charged by a roller charger 17 supplied with only a DC voltage. After the charging and electrostatic latent image formation by exposure to laser light, the electrostatic image was developed with a toner image to form a toner image, which was then transferred from the photosensitive member 1 to a transfer material 27 by a transfer roller 14 supplied with a bias voltage of +700 volts.

The photosensitive member 1 was charged to a dark-part potential of −580 volts and exposed to provide a light-part potential of −150 volts. The transfer material 27 was plain paper of 75 g/m$^2$.

By using the above-remodeled image forming apparatus, each of Toners A–J was subjected to continuous image formation on 5000 sheets in a normal temperature/normal humidity environment (23° C./65%RH), and evaluation was performed with respect to the following items.

a) Soiling on Charger

The soiling on the charging roller 17 was evaluated in terms of a number of sheets in the continuous image formation when image irregularity attributable to soiling on the charging roller occurred in a reproduced halftone image and solid white image on which image defects due to changing failure are liable to occur. A larger number indicates a soiling characteristic of the toner.

b) Transfer Efficiency

Evaluated in the same manner at an initial stage (on a 100th sheet) as in Examples 1–6.

c) Toner Recovery

Toner recovery in the developing step was evaluated by the occurrence or absence of a ghost image (i.e., trace of image in a non-image region) in the resultant image samples. This is because no ghost image occurs in a non-image region, if transfer residual toner remaining on the photosensitive member is recovered in the developing step, whereas if not recovered, the non-recovered toner is further conveyed to the transfer step and can be transferred onto a transfer paper to leave a ghost image. The evaluation was performed according to the following standard.

A: No ghost image occurrence at all.

B: Ghost image occurred at a level that could be recognized only by staring.

C: Ghost occurred, but at a practically acceptable level.

d) Resolution

The reproducibility of discrete dots of 60 μm in diameter (which are generally hard to reproduce because of a closed latent image electric field). The evaluation was performed based on number of lacked dot images among 100 dot images according to the following standard.

A: At most 5 lacked dots.

B: 6–10 lacked dots.

C: 11–20 lacked dots.

D: 21 or more lacked dots.

e) Fog

Evaluated at an initial stage (on a 100th sheet) in the same manner as in Examples 1–6.

Fog evaluation was also performed in a high temperature/high humidity environment (32.5° C./85%RH) and in a low temperature/low humidity environment (10° C./15%RH).

The results are inclusively shown in the following Table 4.

TABLE 4

Image Forming Performance in a Cleanerless System

| | | | | | NT/NH (23° C.)/65% RH) | | | | |
|---|---|---|---|---|---|---|---|---|---|
| | | Fog (%) on 100th sheet | | | Soil on charger* | | Toner | | |
| Example | Toner | NT/NH | HT/HH | LT/LH | On halftone image | On sole | T.E.(%) | recovers | Resolution |
| 7 | A | 0.5 | 0.5 | 0.5 | A | A | 97% | A | A |
| 8 | B | 0.5 | 0.4 | 0.6 | A | A | 98 | A | A |
| 9 | C | 0.4 | 0.3 | 0.4 | A | A | 99 | A | B |
| 10 | D | 1.0 | 1.8 | 0.8 | B(4000) | A | 93 | B | A |
| 11 | E | 0.9 | 1.1 | 1.0 | A | A | 98 | A | C |
| 12 | F | 1.2 | 1.7 | 1.6 | B(3000) | A | 92 | C | A |
| Comp.5 | G | 1.5 | 1.7 | 1.5 | C(500) | C(3000) | 83 | C | C |
| Comp.6 | H | 1.1 | 1.3 | 1.2 | C(1000) | C(4000) | 86 | C | C |
| Comp.7 | I | 1.8 | 2.1 | 2.0 | C(1000) | C(4000) | 89 | C | C |
| Comp.8 | J | 1.2 | 2.0 | 1.3 | C(2000) | C(4500) | 89 | C | C |

*A: No image defects due to soiling up to 5000 sheets.
B(4000 or 3000): Slight defects were observed on an about 4000th or 3000th sheet.
C(500, 1000, . . .): Noticeable defects occurred on a 500th, 1000th sheets, . . .

Production Example 7 for Hydrophobic Iron Oxide

Into an aqueous solution of ferrous sulfate, an aqueous caustic solution in an amount of 1.0–1.1 equivalent to the iron ions in the ferrous sulfate solution was added to form an aqueous solution containing ferrous hydroxide.

While the aqueous solution was maintained at pH 9, air was blown thereinto to cause the oxidation reaction at 80–90° C., thereby forming a slurry liquid containing speed crystals.

Then, to the slurry liquid, a ferrous sulfate aqueous solution in an amount of 0.9–1.2 equivalent to the initial alkali amount (sodium component in the caustic soda) was added, and then while keeping the slurry at pH 8, air was blown thereinto to provide with oxidation. After the oxidation, the resultant iron oxide particles were washed and recovered by filtering to obtain a wet product. A portion of the wet product was measured with respect to the moisture content. Then, the wet product (without being dried) was re-dispersed, in another aqueous medium, and the dispersion liquid was adjusted to pH of ca. 6. Into the dispersion liquid under a sufficient stirring, 0.5 wt. % (based on the iron oxide particles on a dry basis in the wet product) of silane coupling agent ($n\text{-}C_{10}H_{21}OSi(CH_3)_3$) was added to effect a coupling treatment (hydrophobization). The thus hydrophobized iron oxide particles were washed, filtered out, dried and slightly disintegrated to obtain Hydrophobic iron oxide 7.

Production Example 8 for Non-hydrophobized Iron Oxide

Oxidation was performed in the same manner as in Production Example 7. The magnetic iron oxide particles after the oxidation were washed, filtered out, dried, and disintegrated to obtain Non-hydrophobized iron oxide a.

Production Example 9 for Hydrophobic Iron Oxide

Non-hydrophobized iron oxide a obtained in Production Example 8 was dispersed in an aqueous solution, and after the liquid pH was adjusted to ca. 6, 0.5% of silane coupling agent ($n\text{-}C_{10}H_{21}Si(OCH_3)_3$) was added under a sufficient stirring. The resultant hydrophobized iron oxide particles were washed, filtered out, dried and slightly disintegrated to obtain Hydrophobic iron oxide 8.

Production Example 10 for Hydrophobic Iron Oxide

Hydrophobic iron oxide 9 was prepared in the same manner as in Production Example 7 except for reducing the amount of the ferrous sulfate aqueous solution and increasing the blowing rate of air for the synthesis of magnetic iron oxide particles.

Production Example 11 for Hydrophobic Iron Oxide

Hydrophobic iron oxide 10 was prepared in the same manner as in Production Example 7 except for increasing the amount of the ferrous sulfate aqueous solution and reducing the blowing rate of air for the synthesis of magnetic iron oxide particles.

Production Example 12 for Hydrophobic Iron Oxide

Hydrophobic iron oxide 11 was prepared in the same manner as in Production Example 7 except for increasing the blowing rate of air for the synthesis of magnetic iron oxide particles.

The particle size data of the above-prepared iron oxide particles are summarized in the following Table 5.

TABLE 5

| | | Distribution | |
|---|---|---|---|
| Iron oxide | Dv* (μm) | 0.03–0.1 μm (% by number) | ≧0.3 μm (% by number) |
| Hydrophobic 7 | 0.18 | 22 | 1 |
| Hydrophobic 8 | 0.20 | 16 | 3 |

TABLE 5-continued

| Iron oxide | Dv* (μm) | Distribution 0.03–0.1 μm (% by number) | Distribution ≧0.3 μm (% by number) |
|---|---|---|---|
| Hydrophobic 9 | 0.31 | 7 | 12 |
| Hydrophobic 10 | 0.16 | 37 | 7 |
| Hydrophobic 11 | 0.24 | 6 | 8 |
| Non-Hydrophobic a | 0.27 | 11 | 14 |

Example 13

Into 709 parts of deionized water, 451 parts of 0.1 mol/l-$Na_3PO_4$ aqueous solution was added, and the mixture was heated to 60° C., followed by gradual addition of 67.7 parts of 1.0 mol/l-$CaCl_2$ aqueous solution to form an aqueous medium containing $Ca_3(PO_4)_2$.

Separately, the following ingredients:

| | |
|---|---|
| Styrene | 80 parts |
| n-Butyl acrylate | 20 parts |
| Unsaturated polyester resin (condensation product of polypylene oxide addition product and ethylene oxide addition produce with fumaric acid) | 2 parts |
| Negative charge control agent (Monoazo dye Fe compound of a formula shown below) | 4 parts |
| Hydrophobic iron oxide 7 | 80 parts |

were uniformly dispersed and mixed by an attritor ("ATTRITOR", available from Mitsui Miike Kakoki K.K.) to form a monomer composition.

Into the above monomer composition warmed at 60° C., 10 parts of ester wax (having a DSC heat-absorption peak at 75° C.) was mixed and dissolved, and polymerization initiators including 8 parts of 2,2'-azobis(2,4-dimethylvaleronitrile) ($t_{1/2}$ (halflife) at 60° C.=140 mim.) and 2 parts of dimethyl-2,2'-azobisisobutyrate ($t_{1/2}$ (at 60° C.)=270 min., $t_{1/2}$ (at 80° C.)=80 min.) were added to form a polymerizable monomer composition.

Into the above-prepared aqueous medium, the polymerizable monomer composition was charged, and the system was stirred at 10,000 rpm for 15 min. by means of a homomixer ("TK-HOMOMIXER", available from Tokushu Kika Kogyu K.K.) at 60° C. in an $N_2$ environment to form particles (or droplets) of the polymerizable monomer composition. Thereafter, the system was stirred by paddle-stirring blades and subjected to 1 hour of reaction at 60° C., followed further by stirring for 10 hours at 80° C. After the reaction, the suspension liquid was cooled, and hydrochloric acid was added thereto to dissolve $Ca_3(PO_4)_2$. Then, the polymerizate was filtered out, washed with water and dried to obtain toner particles (D4=7.0 μm).

Then, 100 parts of the toner particles were blended with 1.2 parts of hydrophobic silica fine powder ($S_{BET}$=200 $m^2/g$ after hydrophobization) formed by hydrophobization treatment with hexamethyldisilazane, by means of a Henschel mixer (available from Mitsui Miike Kakoki K.K.) to obtain Toner U having a weight-average particle size (D4) of 7.0 μm.

Toner U was subjected to a TEM observation of states of dispersion of iron oxide particles in toner particles similarly as in Example 1. As a result of the observation, Toner U provided a $n_c/n_t$ ratio close to ¼, thus exhibiting a very uniform distribution of iron oxide particles in the toner particles.

Example 14

100 parts of magnetic toner particles (D4=6.9 μm) prepared in the same manner as in Example 13 were blended Monoazo dye Fe compound

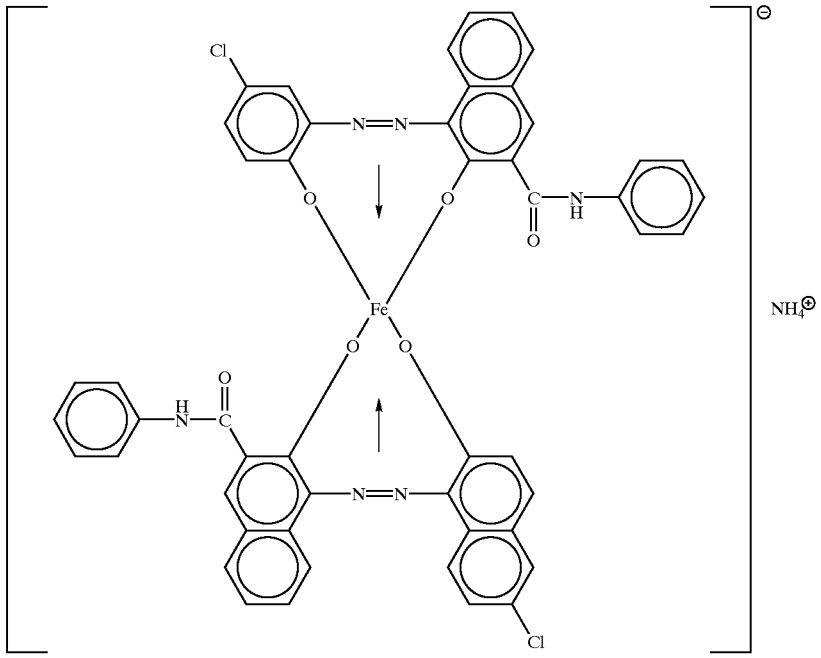

with 1.2 parts of hydrophobic silica fine powder ($S_{BET}$=180 $m^2/g$ after hydrophobization) formed by sequential treatment with hexamethyldisilazane and then with silicone oil by means of a Henschel mixer to obtain Toner V.

Example 15

Magnetic toner particles (D4=3.8 μm) were prepared in the same manner as in Example 13 except for changing the amounts of the $Na_3PO_4$ aqueous solution and the $CaCl_2$ aqueous solution, and further adding sodium dodecylbenzenesulfonate in the dispersion medium. Then, 100 parts of the toner particles and 2.5 parts of the hydrophobic silica fine powder used in Example 14 were blended by means of a Henschel mixer to obtain Toner W.

Example 16

Magnetic toner particles (D4=10.4 μm) were prepared in the same manner as in Example 13 except for changing the amounts of the $Na_3PO_4$ aqueous solution and the $CaCl_2$ aqueous solution. Then, 100 parts of the toner particles and 0.8 part of the hydrophobic silica fine powder used in Example 14 were blended by means of a Henschel mixer to obtain Toner X.

Example 17

Magnetic toner particles (D4=8.2 μm) were prepared in the same manner as in Example 13 except for changing the amount of the ester wax to 51 parts. Then, 100 parts of the toner particles and 1.1 parts of the hydrophobic silica fine powder used in Example 14 were blended by a Henschel mixer to obtain Toner Y.

Example 18

Magnetic toner particles (D4=6.8 μm) were prepared in the same manner as in Example 13 except for changing the amount of the ester wax to 0.8 part. Then, 100 parts of the toner particles and 1.2 parts of the hydrophobic silica fine powder used in Example 14 were blended by a Henschel mixer to obtain Toner Z.

Example 19

Magnetic toner particles (D4=8.4 μm) were prepared in the same manner as in Example 13 except for using 10 parts of low molecular weight polyethylene wax (showing a DSC heat-absorption peak at 115° C.) instead of the ester wax. Then, 100 parts of the toner particles and 1.1 parts of the hydrophobic silica fine powder used in Example 14 were blended by a Henschel mixer to obtain Toner AA.

Example 20

Magnetic toner particles (D4=6.9 μm) were prepared in the same manner as in Example 13 except for changing the amount of Hydrophobic iron oxide 7 to 30 parts. Then, 100 parts of the toner particles and 1.2 parts of the hydrophobic silica fine powder used in Example 14 were blended by a Henschel mixer to obtain Toner BB.

Example 21

Magnetic toner particles (D4=7.9 μm) were prepared in the same manner as in Example 13 except for changing the amount of Hydrophobic iron oxide 7 to 205 parts. Then, 100 parts of the toner particles and 1.1 parts of the hydrophobic silica fine powder used in Example 14 were blended by a Henschel mixer to obtain Toner CC.

Examples 22–24

Three types of magnetic toner particles were prepared in the same manner as in Example 13 except for using Hydrophobic iron oxides 9–11, respectively, instead of Hydrophobic iron oxide 7. Then, 100 parts of each type of toner particles and 1.2 parts of the hydrophobic silica fine powder used in Example 14 were blended by a Henschel mixer to obtain Toners DD–FF.

Comparative Example 9

Magnetic toner particles (D4=8.8 μm) were prepared in the same manner as in Example 13 except for using 80 parts of Non-hydrophobized iron oxide a instead of Hydrophobic iron oxide 7. Then, 100 parts of the toner particles and 1.0 part of the hydrophobic silica fine powder used in Example 14 were blended by a Henschel mixer to obtain Toner GG.

The toner GG was subjected to observation of states of dispersion of iron oxide particles in toner particles through a TEM in the same manner as in Example 1, whereby Toner GG provided a ratio $n_c/n_t$ of ca. ⅛, thus indicating ununiform distribution of iron oxide particles in toner particle and particularly predominant presence at the surface region of toner particles.

Comparative Example 10

Magnetic toner particles (D4=8.1 μm) were prepared in the same manner as in Example 13 except for using 80 parts of Hydrophobic iron oxide 9 instead of Hydrophobic iron oxide 7. Then, 100 parts of the toner particles and 1.0 part of the hydrophobic silica fine powder used in Example 14 were blended by a Henschel mixer to obtain Toner GG.

The toner HH was subjected to observation of states of dispersion of iron oxide particles in toner particles through a TEM in the same manner as in Example 1, whereby Toner HH provided a ratio $n_c/n_t$ of ca. ⅙, thus indicating ununiform distribution of iron oxide particles in toner particle and particularly predominant presence at the surface region of toner particles.

Comparative Example 11

| | |
|---|---|
| Styrene/n-butylacrylate copolymer (80/20 by weight) | 20 parts |
| Unsaturated polyester resin (the same as in Example 13) | 2 parts |
| Negative control agent (the same as in Example 13) | 4 parts |
| Hydrophobic iron oxide 7 | 80 parts |
| Ester wax | 5 parts |

(the same as in Example 13)

The above ingredients were blended in a blender and melt-kneaded through a twin-screw extruder heated at 110° C. After cooling, the kneaded product was coarsely crushed by a hammer mill and finely pulverized by a jet mill, followed by pneumatic classification to obtain magnetic toner particles (D4=10.4 μm). Then, 100 parts of the toner particles and 0.8 part of the hydrophobic silica fine powder used in Example 14 were blended in a Henschel mixer to obtain Toner II.

Comparative Example 12

The coarsely crushed kneaded product in Comparative Example 11 was further pulverized by a turbomill (available from TURBOMILL Kogyo K.K.) to obtain magnetic toner particles, which were then treated by means of an impact type surface treatment apparatus (at 50° C., a rotating blade peripheral speed of 90 m/sec) to obtain sphered toner particles (D4=10.3 μm). Then, 100 parts of the sphered toner particles and 0.8 part of the hydrophobic silica fine powder used in Example 14 were blended in a Henschel mixer to obtain Toner JJ.

Comparative Example 13

Into 709 parts of deionized water, 451 parts of 0.1 mol/l-$Na_3PO_4$ aqueous solution was added, and the mixture was heated to 60° C., followed by gradual addition of 67.7 parts of 1.0 mol/l-$CaCl_2$ aqueous solution, to form an aqueous medium containing $Ca_3(PO_4)_2$.

| | |
|---|---|
| Styrene | 80 parts |
| n-butyl acrylate | 20 parts |
| Unsaturated polyester resin (the same as in Example 13) | 2 parts |
| Negative charge control agent (the same as in Example 13) | 4 parts |
| Hydrophobic iron oxide 7 | 96 parts |

were uniformly dispersed and mixed by an attritor ("ATTRITOR", available from Mitsui Miike Kakoki K.K.) to form a monomer composition.

Into the above monomer composition warmed at 60° C., 12 parts of the ester wax (used in Example 13) was mixed and dissolved, and polymerization initiators including 8 parts of 2,2'-azobis(2,4-dimethylvaleronitrile) ($t_{1/2}$ (halflife) at 60° C.=140 mm.) and 2 parts of dimethyl-2,2'-azobisisobutyrate ($t_{1/2}$ (at 60° C.)=270 min., $t_{1/2}$ (at 80° C.)=80 min.) were added to form a polymerizable monomer composition.

Into the above-prepared aqueous medium, the polymerizable monomer composition was charged, and the system was stirred at 10,000 rpm for 15 min. by means of a homomixer ("TK-HOMOMIXER", available from Tokushu Kika Kogyu K.K.) at 60° C. in an $N_2$ environment to form particles (or droplets) of the polymerizable monomer composition. Thereafter, the system was stirred by paddle-stirring blades and subjected to 1 hour of reaction at 60° C., followed further by stirring for 10 hours at 80° C.

Then, into the above aqueous suspension system after polymerization, a mixture of

| | |
|---|---|
| Styrene | 16 part(s) |
| n-Butyl acrylate | 4 part(s) |
| 2,2'-azobis(2,4-dimethylvalero-nitrile) | 0.4 part(s) |
| Sodium behenate | 0.1 part(s) |
| Water | 20 part(s) |

was added, and the system was further heated to 80° C., followed by 10 hours of stirring. After the reaction, the suspension liquid was cooled, and hydrochloric acid was added thereto to dissolve $Ca_3(PO_4)_2$. Then, the polymerizate was filtered out, washed with water and dried to obtain toner particles (D4=8.5 μm).

Then, 100 parts of the toner particles and 1.0 part of the hydrophobic silica fine powder used in Example 14 were blended in a Henschel mixer to obtain Toner KK.

Comparative Example 14

Magnetic toner particles (D4=8.3 μm) were prepared in the same manner as in Comparative Example 13 except for using 96 parts of Non-hydrophobized iron oxide a instead of Hydrophobic iron oxide 7. Then, 100 parts of the toner particles and 1.0 part of the hydrophobic silica fine powder used in Example 14 were blended by a Henschel mixer to obtain Toner LL.

The characteristic features of the above-prepared toners are summarized in the following Table 6.

TABLE 6

| | | Wax TDSC | Toner | | | | Silica agent |
|---|---|---|---|---|---|---|---|
| Toner | Iron oxide* amount | amount (parts) | D4 | ϕ av. | B/A | D/C < 0.02 (N %) | amount (parts) |
| U | H.P.7 2 parts | 75 ° C. 10 parts | 7.0 μm | 0.984 | 0.0002 | 83 | HDMS 1.2 parts |
| V | " | " | 6.9 | 0.983 | 0.0001 | 82 | HDMS + S.O. 1.2 parts |
| W | " | " | 3.8 | 0.985 | 0.0006 | 94 | HDMS + S.O. 2.5 parts |
| X | " | " | 10.4 | 0.979 | 0.0001 | 74 | HDMS + S.O. 0.8 parts |
| Y | " | 75° C. 51 parts | 8.2 | 0.971 | 0.0004 | 87 | HDMS + S.O. 1.1 parts |
| Z | " | 75° C. 0.4 parts | 6.8 | 0.986 | 0.0002 | 81 | HDMS + S.O. 1.2 parts |
| AA | " | 115° C. 10 parts | 8.4 | 0.970 | 0.0003 | 85 | HDMS + S.O. 1.1 parts |
| BB | H.P.7 30 parts | 75° C. 10 parts | 6.9 | 0.988 | 0.0000 | 63 | HDMS + S.O. 1.2 parts |
| CC | H.P.7 205 parts | " | 7.9 | 0.971 | 0.0009 | 92 | HDMS + S.O. 1.1 parts |
| DD | H.P.9 80 parts | " | 7.2 | 0.970 | 0.0001 | 63 | HDMS + S.O. 1.2 parts |
| EE | H.P.10 80 parts | " | 7.1 | 0.973 | 0.0009 | 90 | " |
| FF | H.P.11 380 parts | " | 7.3 | 0.972 | 0.0001 | 62 | " |
| GG | HNP a 80 parts | " | 8.8 | 0.963 | 0.0063 | 100 | HDMS + S.O. 1.0 parts |
| HH | H.P.8 80 parts | " | 8.1 | 0.974 | 0.0012 | 98 | HDMS + S.O. 1.1 parts |
| II*1 | H.P.7 80 parts | 75° C. 5 parts | 10.4 | 0.921 | 0.0019 | 100 | HDMS + S.O. 0.8 parts |
| JJ*1 | " | " | 10.3 | 0.966 | 0.0009 | 94 | " |
| KK | " | 75° C. 10 parts | 8.5 | 0.972 | 0.0000 | 44 | HDMS + S.O. 1.0 parts |
| LL | NHP a 96 parts | " | 8.3 | 0.969 | 0.0000 | 49 | " |

*1: Pulverization process toner.
*2: H.P. = Hydrophobic, NHP = Non-hydrophobized Each of the above-prepared Toners U–Z and AA–LL was evaluated by image formation by using an image forming apparatus having an organization generally as illustrated in FIG. 1.

The photosensitive member 100 used had an organization as illustrated in FIG. 8 and described as follows. That is, an aluminum (Al) cylinder 10*a* as a substrate having a diameter of 30 mm was successively coated by dipping with the following layers:

(1) an electroconductive coating layer 10*b:* a 15 μm-thick layer principally comprising phenolic resin coating tin oxide and titanium oxide powder dispersed therein;

(2) an undercoating layer 10*c:* a 0.6 μm-thick layer principally comprising modified nylon and copolymer nylon;

(3) a charge generation layer 10*d:* a 0.6 μm-thick layer principally comprising butyral resin containing an azo pigment dispersed therein showing absorptivity in a long wavelength region; and (4) a charge transport layer 10*e:* a 20 μm-thick layer comprising a 8:10 (by weight)-mixture of a hole-transporting triphenylamine compound and polycarbonate resin (having a molecular weight of $2\times10^4$ according to an Ostwald viscometer) and further containing 10 wt. % of polytetrafluoroethylene powder (0.2 μm) dispersed therein. The charge transport layer exhibited a contact angle with pure water of 95 deg. as measured by using a contact angle meter ("Model CA-X", available from Kyowa Kaimen Kagaku K.K.).

A rubber roller charger 117 containing electroconductive carbon dispersed therein and coated with a nylon resin layer was abutted against the photosensitive member 100 at a pressure of 60 g/cm to uniformly charge the photosensitive member 100 under application of a bias voltage of DC −700 volts superposed with AC 2.0 kVpp. The charged photosensitive member 100 was exposed to laser light 123 to form an electrostatic latent image thereon while setting a dark part potential Vd=−700 volts and a light-part potential Vl=−200 volts.

The photosensitive member 100 and the developing sleeve (toner-carrying member) 102 were disposed to leave a gap of 280 μm therebetween. The developing sleeve comprised a 20 mm-dia. cylindrical Al sleeve having mirror-finished surface and coated with a ca. 7 μm-thick resin layer having a composition shown below and exhibiting an average surface roughness Ra (JIS-center line) of 1.3 μm. The developing sleeve 102 was equipped with a developing pole of 95 mT (950 Gauss) and a toner regulating member of a urethane rubber blade having a thickness of 1.0 mm and a free length of 10 mm and abutted to the developing sleeve at a pressure of 14.7 N/m (1.5 kg/m).

[Sleeve Surface Layer Composition]

| | |
|---|---|
| Phenolic resin | 100 parts |
| Graphite (7 μm) | 90 parts |
| Carbon black | 10 parts |

In operation, the developing sleeve was supplied with a developing bias voltage of Vdc=−400 volts superposed with an AC voltage of Vac=1600 Vpp and f=2000 Hz. The developing sleeve was rotated in an identical surface moving direction as the photosensitive member 100 and at a peripheral speed of 88 mm which was 110% of the moving speed (80 mm) of the photosensitive member 100.

The image forming apparatus was further equipped with a 20 mm-dia. transfer roller 34 as shown in FIG. 5 (114 in FIG. 1) surfaced with an electroconductive surface layer 34*b* of ethylene-propylene with electroconductive carbon dispersed therein so as to exhibit a volume resistivity of $10^8$ ohm.cm and a surface rubber hardness of 24 deg. The transfer roller 34 was abutted against the photosensitive member at a pressure of 59 N/m (6 kg/m) and rotated at a peripheral speed of 80 mm/sec identical to that of the photosensitive member 100 rotating in the direction A. A transfer bias voltage of Vdc=1.5 k-volts was applied thereto. The fixing was performed by using a hot roller fixation device.

An continuous image forming test was performed in an environment of 15° C./10%RH on a transfer paper of 90 g/m$^2$ up to a maximum of 5000 sheets.

Continuous image forming performance was principally evaluated based on a halftone image (longitudinal line patterns giving a printing image area proportion of 5%) in which image defects attributable to abrasion of and toner sticking onto the photosensitive member were liable to occur, in terms of a number of continuously printed sheets when such image defects, as block spots or white dropout, attributable to the abrasion and toner sticking on the photosensitive member, were recognized. A larger number indicates a better continuous image forming performance. Moreover, image defects attributable to primary charging failure due to transfer residual toner, such as charging irregularity, were also evaluated on halftone images.

Further, the following items were also evaluated.

a) Transfer efficiency (T.E.) was evaluated in the same manner as in Example 1.

b) Resolution at the initial stage (on a 100th sheet) of continuous image formation was evaluated in the same manner as in Example 7.

c) Image density (I.D.) was measured in the same manner as in Example 1.

d) Fog was evaluated in the same manner as in Example 1.

e) Offset (during fixation) was evaluated in terms of number of image sample sheets carrying offset soil on the back among the initially formed 100 image sample sheets.

Example 13

When Toner U was used, a high transfer efficiency was attained at the initial stage. Further, good images were generally obtained free from image defects, such as transfer dropout, back soiling due to fixation offset or fog onto non-image portions.

While the evaluation results for the respective toners are summarized in Table 7, brief comments on evaluation of the respective toners are given below.

Example 14

Toner V provided very good results up to 5000 sheets.

Examples 15–24

Toners W–FF provided results of practically no problem.

Comparative Example 9

Toner GG resulted in black spots in halftone images attributable to abrasion of the photosensitive member from 2500 sheets and white dropout attributable to toner sticking from 3000 sheets. This is presumably because Non-hydrophobized iron oxide a caused much exposure to the toner particle surfaces, so that transfer residual toner abraded the photosensitive member by rubbing with the charging roller.

Comparative Example 10

Toner HH resulted in black spots in halftone images attributable to abrasion of the photosensitive member from 3500 sheets and white dropout attributable to toner sticking from 4000 sheets. It is supposed that the used Hydrophobic iron oxide 8 was insufficient in hydrophobization so that the exposure of iron oxide particles was not sufficiently prevented to result in abrasion of the photosensitive member with transfer residual toner by rubbing with the charging roller.

Comparative Example 11

Toner II resulted in black spots in halftone images attributable to abrasion of the photosensitive member from 1000 sheets, white dropout attributable to toner sticking from 1500 sheets and also charging irregularity due to transfer residual toner from 2000 sheets. It is supposed that even if a sufficiently hydrophobized iron oxide (Hydrophobic iron oxide 7) was used, the exposure thereof to the toner particle surfaces could not be sufficiently prevented if the toner particles were produced through an ordinary pulverization process, so that transfer residual toner abraded the photosensitive member at the time of rubbing by the charging roller. Moreover, the toner particles of toner circularity caused abrasion with their edges, thus accelerating the deterioration of the photosensitive member.

Comparative Example 12

Toner JJ resulted in black spots in halftone images attributable to abrasion of the photosensitive member from 2500 sheets, white dropout attributable to toner sticking from 3000 sheets and also charging irregularity due to transfer residual toner from 3500 sheets. It is supposed that even if the sphering treatment for providing Toner JJ improved the exposure of iron oxide particles from the toner particle surfaces, the circularity was still insufficient, so that the abrasion of the photosensitive member due to edge of toner particles could not be sufficiently prevented.

Comparative Example 13

Toner KK provided results free from image defects attributable to abrasion of the photosensitive member. However, as the number of continuous image formation increased, the image density was gradually lowered down to 0.71 on a 5000th sheet or later. Further, after 4000 sheets, fixed image sheet sometimes caused back soiling. This is presumably because the particles of D/C≦0.02 were contained at a low proportion of 44%, i.e., the dispersion of iron oxide particles in toner particles were poor, so that relatively large toner particles containing a larger proportion of iron oxide particles thus exhibiting lower developing performance and fixability were selectively left at a final stage of the continuous image formation.

Comparative Example 14

Toner LL provided results free from image defects attributable to abrasion of the photosensitive member. However, as the number of continuous image formation increased, the image density was gradually lowered down to 0.67 on a 5000th or later. Further, after 3500 sheets, fixed image sheets were sometimes accompanied with back soiling. It is assumed that similarly as Toner K.K. used in Comparative Example 14, Toner LL caused selective remaining of longer toner particles showing lower developing an fixing performances. Further, from 4000 sheets, charging irregularity due to transfer residual toner was caused. This is presumably because, a lower circularity of the toner caused an increase in transfer residual toner. It is assumed that these difficulties were all attributable to the use of Non-hydrophobized iron oxide a for the toner production.

TABLE 7

| | | Image Forming Performances (in 15° C./10% RH) | | | | | |
|---|---|---|---|---|---|---|---|
| | | Initial performance (on 100th sheet) | | | | Offset*1 | Image defects |
| Example | Toner | I.D. | Fog | T.E. | Resolution | sheets (/100 sheets) | in halftone images *2 |
| 13 | U | 1.47 | 0.6 | 96% | A | none | BS(>4500) |
| 14 | V | 1.52 | 0.5 | 98 | A | none | A |
| 15 | W | 1.34 | 1.9 | 91 | A | none | BS(>4500) |
| 16 | X | 1.5 | 0.5 | 98 | C | none | A |
| 17 | Y | 1.3 | 2.1 | 90 | B | none | BS(>4500) |
| 18 | Z | 1.52 | 0.4 | 98 | A | 4/100 | A |
| 19 | AA | 1.4 | 0.9 | 90 | B | 9/100 | BS(>4500) |
| 20 | BB | 1.3 | 0.1 | 99 | A | none | A |
| 21 | CC | 1.29 | 0.2 | 95 | B | 5/100 | BS(>4000)<br>WD(>4500) |
| 22 | DD | 1.28 | 1.4 | 90 | C | none | BS(4000)<br>WD > 4500)<br>ID1.09(5000) |
| 23 | EE | 1.34 | 0.8 | 93 | B | none | BS(>3500)<br>WD(>4000) |
| 24 | FF | 1.29 | 1.5 | 90 | B | none | BS(>4000)<br>WD(>4500) |
| Comp.9 | GG | 1.29 | 1.9 | 92 | C | none | BS(3000)<br>WD(3500) |
| Comp.10 | HH | 1.32 | 1.8 | 94 | B | none | BS(3500)<br>WD(4000) |
| Comp.11 | 11 | 1.28 | 2.5 | 81 | D | 3/100 | BS(1000)<br>WD(1500)<br>CI(2000) |
| Comp.12 | JJ | 1.3 | 2.3 | 88 | C | 3/100 | BS(2500)<br>WD(3000)<br>CI(3500) |

TABLE 7-continued

| | | Image Forming Performances (in 15° C./10% RH) | | | | | |
|---|---|---|---|---|---|---|---|
| | | Initial performance (on 100th sheet) | | | | Offset*1 | Image defects |
| Example | Toner | I.D. | Fog | T.E. | Resolution | sheets (/100 sheets) | in halftone images *2 |
| Comp.13 | KK | 1.31 | 1.9 | 90 | B | OS1 | BS(4000)<br>WD(4500)<br>ID0.71(5000) |
| Comp.14 | LL | 1.27 | 2.4 | 87 | C | OS2 | BS(4000)<br>CI(4000)<br>WD(4500)<br>ID0.67(5000) |

[Remarks to Table 7]

*1: OS1=None, but occurred at a rate of 4 sheets/100 sheets after 4000 sheets of continuous image formation.

OS2=None, but occurred at a rate of 4 sheets/100 sheets after 3500 sheets of continuous image formation.

*2 A=Not at all up to 5000 sheets.

BS (>4500)=Slight black spot occurred on a 4500th sheet.

BS (>4000)=Slight black spot occurred on a 4000th sheet.

BS (3000)=Black spot occurred on a 3000th sheet.

WD (>4500)=Slight white dropout occurred on a 4000th sheet.

WD (4000)=White dropout occurred on a 4000th sheet.

CI (4000)=Charging irregularity occurred on a 4000th sheet.

ID 1.09 (5000)=Image density was lowered to 1.09 on a 5000th sheet.

What is claimed is:

1. A toner, comprising: toner particles each comprising at least a binder resin and iron oxide particles, wherein (i) the toner particles exhibit a carbon content (A) and an iron content (B) giving a ratio B/A<0.001 at surfaces of the toner particles as measured by X-ray photoelectron spectroscopy, (ii) the toner particles exhibit an average circularity of at least 0.970, (iii) the toner particles contain at least 50% by number of toner particles satisfying D/C≦0.02, wherein C denotes a projection area-equivalent circular diameter of each toner particle and D denotes a minimum distance of iron oxide particles from a surface of the toner particle, based oil a sectional view of the toner particle as observed through a transmission electron microscope (TEM), and (iv) the iron oxide particles have a volume-average particle size of 0.1–0.3 μm and contain at most 40% by number of particles having sizes of 0.03–0.1 μm.

2. The toner according to claim 1, wherein the toner particles have been formed by polymerization in an aqueous dispersion medium.

3. The toner according to claim 1, wherein the toner particles exhibit a ratio B/A of below 0.0005.

4. The toner according to claim 1, wherein the toner particles contain at least 65% by number of particles satisfying D/C≦0.02.

5. The toner according to claim 1, wherein the toner particles contain at least 75% by number of particles satisfying D/C≦0.02.

6. The toner according to claim 1, wherein the iron oxide is hydrophobized iron oxide and is contained in 10–200 wt. parts per 100 wt. parts of the binder resin.

7. The toner according to claim 1, wherein the iron oxide is hydrophobized iron oxide and is contained in 20–180 wt. parts per 100 wt. parts of the binder resin.

8. The toner according to claim 1, wherein the toner has a weight-average particle size of 2–10 μm.

9. The toner according to claim 1, wherein the toner has a weight-average particle size of 3.5–8 μm.

10. The toner according to claim 1, wherein the toner contains hydrophobic silica treated with silicone oil in addition to the toner particles.

11. The toner according to claim 1, wherein the iron oxide particles have been surface-treated with a coupling agent in an aqueous medium.

12. The toner according to claim 11, wherein the coupling agent comprises an alkyltrialkoxysilane coupling agent.

13. The toner according to claim 1, wherein the iron oxide particles are magnetic iron oxide particles produced by adding an alkali to an aqueous ferrous salt solution, oxidizing the ferrous salt at an elevated temperature, and further adding an aqueous ferrous salt solution.

14. The toner according to claim 1, wherein the iron oxide particles contain at most 30% by number of particles of 0.03–0.1 μm, and at most 10% by number of particles of at least 0.3 μm.

15. The toner according to claim 1, wherein the iron oxide particles contain at most 30% by number of particles of 0.03–0.1 μm, and at most 5% by number of particles of at least 0.3 μm.

16. The toner according to claim 1, wherein the toner contains 0.5–50 wt. % of a wax per 100 wt. parts of the binder resin.

17. The toner according to claim 16, wherein the wax shows a maximum heat-absorption peak in a temperature range of 40–110° C. on a DSC curve measured by differential scanning calorimetry on temperature increase.

18. The toner according to claim 1, wherein the toner particles have been formed through suspension polymerization.

19. An image forming method, comprising:

a charging step of charging an electrostatic image-bearing member with a charging member receiving a voltage from an external voltage supply, an exposure step of exposing the electrostatic image-bearing member to form an electrostatic latent image thereon;

a developing step of developing the electrostatic latent image with a toner carried on a toner-carrying member to form a toner image on the electrostatic image-bearing member; and a transfer step of transferring the toner image onto a transfer-receiving material, wherein the toner comprises toner particles each comprising at least a binder resin and iron oxide particles, wherein (i) the toner particles exhibit a carbon content (A) and an iron content (B) giving a ratio B/A<0.001 at surfaces of the toner particles as measured by X-ray photoelectron spectroscopy, (ii) the toner particles exhibit an average circularity of at least 0.970, (iii) the toner particles contain at least 50% by number of toner particles satisfying D/C≦0.02, wherein C denotes a projection area-equivalent circular diameter of each toner particle and D denotes a minimum distance of iron oxide particles from a surface of the toner particle, based on a sectional view of the toner particle as observed through a transmission electron microscope (TEM), and (iv) the iron oxide particles have a volume-average particle size of 0.1–0.3 μm and contain at most 40% by number of particles having sizes of 0.03–0.1 μm.

20. The image forming method according to claim 19, wherein the developing step is a contact developing step wherein the electrostatic latent image is developed with the toner while the electrostatic image on the electrostatic image-bearing member contacts the toner carried on the toner-carrying member.

21. The image forming method according to claim 20, wherein the toner carrying member comprises an elastic roller.

22. The image forming method according to claim 20, wherein in a developing region, the toner-carrying member is moved at a surface moving speed which is 1.05–3.0 times that of the electrostatic image bearing member.

23. The image forming method according to claim 20, wherein the toner-carrying member has a surface roughness Ra of 0.2–3.0 μm.

24. The image forming method according to claim 20, wherein residual toner on the electrostatic image-bearing member is recovered simultaneously with the developing step.

25. The image forming method according to claim 19, wherein the developing step is a non-contact developing step wherein the toner is disposed on the toner-carrying member in a layer thickness smaller than a closest gap between the electrostatic image-bearing member and the toner-carrying member and is transferred onto the electrostatic image in a developing region under application of an alternating bias electric field.

26. The image forming method according to claim 25, wherein the closest gap between the electrostatic image-bearing member and the toner-carrying member is 100–500 μm.

27. The image forming method according to claim 25, wherein in the developing region, the toner-carrying member is moved at a surface moving speed which is 1.02–3.0 times that of the electrostatic image bearing member.

28. The image forming method according to claim 25, wherein the toner-carrying member has a surface roughness Ra of 0.2–3.5 μm.

29. The image forming method according to claim 25, wherein the alternating bias electric field has a peak-to-peak field intensity of $3\times10^6$–$1\times10^7$ volts/m and a frequency of 100–5000 Hz.

30. The image forming method according to claim 19, wherein in the charging step, the electrostatic image-bearing member is charged by the charging member in contact with the electrostatic image-bearing member.

31. The image forming method according to claim 19, wherein in the transfer step, the toner image on the electrostatic image-bearing member is transferred onto the transfer-receiving material under action of a transfer member contacting the electrostatic image-bearing member via the transfer-receiving material.

32. The image forming method according to claim 19, wherein in the charging step, the electrostatic image-bearing member is charged by the charging member in contact with the electrostatic image-bang member, and in the developing step, the toner is disposed on the toner-carrying member in a layer thickness smaller than a closest gap between the electrostatic image-bearing member and the toner-carrying member and is transferred onto the electrostatic latent image in a developing region under application of an alternating bias electric field.

33. The image forming method according to claim 19, wherein the toner is carried in a layer of which the thickness is regulated by a toner layer thickness-regulating member abutted against the toner-carrying member.

34. The image forming method according to claim 33, wherein the toner layer thickness regulating member comprises an elastic member.

35. An image forming method comprising:

a charging step of charging an electrostatic image-bearing member with a charging member receiving a voltage from an external voltage supply, an exposure step of exposing the electrostatic image-bearing member for forming an electrostatic latent image thereon;

a developing stop of developing the electrostatic latent image with a toner carried on a toner-carrying member to form a toner image on the electrostatic image-bearing member; and a transfer step of transferring the toner image onto a transfer-receiving material, wherein the toner is a toner according to any one of claims 2–13 and 14–18.

* * * * *

UNITED STATES PATENT AND TRADEMARK OFFICE

CERTIFICATE OF CORRECTION

PATENT NO. : 6,447,969 B1
DATED : September 10, 2002
INVENTOR(S) : Masanori Ito et al.

It is certified that error appears in the above-identified patent and that said Letters Patent is hereby corrected as shown below:

Title page,
Item [56], FOREIGN PATENT DOCUMENTS,

"5443027" should read --54-43027--;
"5484731" should read --54-84731--;
"5518656" should read --55-18656--;
"5613945" should read --56-13945--;
"56104351" should read --56-104351--;
"57178257" should read --57-178257--;
"5840566" should read --58-40566--;
"58139156" should read --58-139156--;
"58150975" should read --58-150975--;
"59133573" should read --59-133573--;
"59200254" should read --59-200254--;
"59200256" should read --59-200256--;
"59200257" should read --59-200257--;
"59224102" should read --59-224102--;
"6134070" should read --61-34070--;
"61279864" should read --61-279864--;
"62203182" should read --62-203182--;
"62279352" should read --62-279352--;
"63133179" should read --63-133179--;
"63149669" should read --63-149669--;
"63235953" should read --63-235953--;
"63250660" should read --63-250660--;
"6420587" should read --64-20587--;
"1112253" should read --1-112253--;
"1191156" should read --1-191156--;
"2123385" should read --2-123385--;
"2214156" should read --2-214156--;
"2284158" should read --2-284158--;
"2302772" should read --2-302772--;
"39045" should read --3-9045--;
"3181952" should read --3-181952--;
"4162048" should read --4-162048--;
"553482" should read --5-53482--;
"561383" should read --5-61383--;
"772654" should read --7-72654--;
"7209904" should read --7-209904--; and
"8136439" should read --8-136439--.

UNITED STATES PATENT AND TRADEMARK OFFICE

CERTIFICATE OF CORRECTION

PATENT NO. : 6,447,969 B1
DATED : September 10, 2002
INVENTOR(S) : Masanori Ito et al.

It is certified that error appears in the above-identified patent and that said Letters Patent is hereby corrected as shown below:

Title page (cont'd),
OTHER PUBLICATIONS,
"63250660," should read -- 63-250660, --;
"Derwent Publ.," should read -- Derwent Publ., Class A11, --; and
"Derwent" should read -- Derwent Publ., Class A12, --.

Column 2,
Line 33, "a ttributable" should read -- attributable --.

Column 4,
Line 35, "case" should read -- cases --.

Column 7,
Line 47, "stipping" should read -- slipping --.

Column 11,
Line 57, "belows." should read -- below. --.

Column 12,
Line 29, "is" should read -- are --.

Column 14,
Line 27, "characterize" should read -- characterized --.

Column 21,
Line 23, "trimthylethoxysilane," should read -- trimethylethoxysilane, --; and
Line 32, "1,3-divinyltetramthyldisiloxane," should read
-- 1,3-divinyltetramethyldisiloxane, --.

Column 30,
Line 8, "sheme" should read -- scheme --.

Column 32,
Line 62, "subjected" should read -- subjected to --; and
Line 65, "3 $\mu$m)." should read -- 3 $\mu$m. --.

Column 33,
Line 9, "is" should read -- are --; and
Line 47, "circulaty" should read -- circularity --.

UNITED STATES PATENT AND TRADEMARK OFFICE

CERTIFICATE OF CORRECTION

PATENT NO. : 6,447,969 B1
DATED : September 10, 2002
INVENTOR(S) : Masanori Ito et al.

It is certified that error appears in the above-identified patent and that said Letters Patent is hereby corrected as shown below:

Column 36,
Line 24, "("TK-HOMOMIXER"" should read -- ("TK-HOMOMIXER", --.

Column 37,
Line 61, "("TK-HOMOMIXER"" should read -- ("TK-HOMOMIXER", --.

Column 38,
Line 61, "a shown" should read -- as shown --.

Column 46,
Line 5, "mim.)" should read -- min.) --.

Column 49,
Line 15, "$Ca_3(PO_4)_2$." should read -- $Ca_3(PO_4)_2$. ¶ Separately, the following ingredients: --.

Column 54,
TABLE 7, "5 ID1.09(5000)" should read -- ID1.09(5000) --.

Column 56,
Line 57, "supply," should read -- supply; --.

Column 58,
Line 21, "wherein" should read -- wherein, --; and
Line 44, "stop" should read -- step --.

Signed and Sealed this

Twenty-ninth Day of July, 2003

JAMES E. ROGAN
*Director of the United States Patent and Trademark Office*